US012527998B2

(12) United States Patent
Mizutani

(10) Patent No.: US 12,527,998 B2
(45) Date of Patent: Jan. 20, 2026

(54) GOLF CLUB HEAD

(71) Applicant: SUMITOMO RUBBER INDUSTRIES, LTD., Kobe (JP)

(72) Inventor: Naruhiro Mizutani, Kobe (JP)

(73) Assignee: SUMITOMO RUBBER INDUSTRIES, LTD., Kobe (JP)

( * ) Notice: Subject to any disclaimer, the term of this patent is extended or adjusted under 35 U.S.C. 154(b) by 30 days.

(21) Appl. No.: 18/233,994

(22) Filed: Aug. 15, 2023

(65) Prior Publication Data

US 2024/0058663 A1 Feb. 22, 2024

(30) Foreign Application Priority Data

Aug. 16, 2022 (JP) ..... 2022-129750

(51) Int. Cl.
*A63B 53/06* (2015.01)
*A63B 53/04* (2015.01)

(52) U.S. Cl.
CPC ..... *A63B 53/06* (2013.01); *A63B 53/0466* (2013.01)

(58) Field of Classification Search
CPC ..... A63B 53/0433; A63B 2053/0491
USPC ..... 473/334–339
See application file for complete search history.

(56) References Cited

U.S. PATENT DOCUMENTS 2,155,830 A * 4/1939 Howard ..... A63B 60/52 473/246
6,089,992 A * 7/2000 Onuki ..... B22D 25/02 473/324
6,089,994 A * 7/2000 Sun ..... A63B 60/02 473/341
6,773,360 B2 * 8/2004 Willett ..... A63B 60/02 473/409
7,153,220 B2 * 12/2006 Lo ..... A63B 60/00 473/340
7,572,193 B2 * 8/2009 Yokota ..... A63B 60/02 473/328
7,637,823 B2 * 12/2009 Shimazaki ..... A63B 53/0466 473/335

(Continued)

FOREIGN PATENT DOCUMENTS

JP 2015020039 A * 2/2015 ..... A63B 53/0433
JP 2016-55109 A 4/2016
JP 2017127626 A * 7/2017 ..... A63B 53/0466

*Primary Examiner* — Alvin A Hunter
(74) *Attorney, Agent, or Firm* — Birch, Stewart, Kolasch & Birch, LLP

(57) ABSTRACT

A head includes at least one adjustment member that is detachably fixed to the head outer surface in a state where a body wall is sandwiched by the adjustment member. A head body has at least one opening that penetrates through the body wall. The adjustment member includes an inner portion, an outer portion, and a rotary connecting portion. Rotational positions of the inner portion include a pass-through position that allows the inner portion to pass through the opening, and a non-pass-through position that prevents the inner portion from passing through the opening. An inner surface abutment part of the inner portion situated at the non-pass-through position abuts against the head inner surface. The head body or the adjustment member includes a corotation prevention portion that prevents the inner portion situated at the non-pass-through position from corotating with the rotary connection portion.

14 Claims, 32 Drawing Sheets

(56) References Cited

U.S. PATENT DOCUMENTS 7,670,235 B2 * 3/2010 Lo ..... A63B 60/02 473/332
7,686,707 B2 * 3/2010 Matsunaga ..... A63B 53/0466 473/332
7,771,290 B2 * 8/2010 Bezilla ..... A63B 60/02 473/335
7,824,280 B2 * 11/2010 Yokota ..... A63B 60/02 473/334
8,192,302 B2 * 6/2012 Knutson ..... A63B 53/0466 473/335
8,197,357 B1 * 6/2012 Rice ..... A63B 60/00 473/335
8,337,319 B2 * 12/2012 Sargent ..... A63B 60/02 473/307
8,388,465 B2 * 3/2013 De La Cruz ..... A63B 53/0466 473/335
8,414,422 B2 * 4/2013 Peralta ..... A63B 53/04 473/335
8,425,348 B2 * 4/2013 Boyd ..... A63B 53/0466 473/335
8,480,511 B2 * 7/2013 Sargent ..... A63B 53/0466 473/309
8,523,702 B2 * 9/2013 Thomas ..... A63B 53/06 473/345
8,540,588 B2 * 9/2013 Rice ..... A63B 53/04 473/335
8,608,589 B2 * 12/2013 Ferguson ..... A63B 53/0466 473/335
8,608,591 B2 * 12/2013 Chao ..... A63B 53/0466 473/345
8,636,603 B2 * 1/2014 Rauchholz ..... A63B 53/14 473/409
8,684,863 B2 * 4/2014 Bezilla ..... A63B 53/06 473/335
8,708,838 B2 * 4/2014 Ferguson ..... A63B 53/0466 473/335
8,753,226 B2 * 6/2014 Rice ..... A63B 60/02 473/335
8,790,195 B1 * 7/2014 Myers ..... A63B 53/0466 473/335
8,858,362 B1 * 10/2014 Leposky ..... A63B 60/02 473/335
8,876,622 B2 * 11/2014 Beach ..... A63B 53/06 473/244
8,905,858 B2 * 12/2014 Nivanh ..... A63B 53/04 473/324
8,944,934 B2 * 2/2015 Yamamoto ..... A63B 53/0466 473/335
8,979,671 B1 * 3/2015 DeMille ..... A63B 60/00 473/335
9,095,753 B2 * 8/2015 Bezilla ..... A63B 53/0466
9,168,439 B2 * 10/2015 Motokawa ..... A63B 53/0466
9,327,173 B2 * 5/2016 Mizutani ..... A63B 53/0466
9,358,431 B2 * 6/2016 Yamamoto ..... A63B 53/04
9,387,376 B1 * 7/2016 Hall ..... A63B 53/06
9,700,770 B2 * 7/2017 Cleghorn ..... A63B 53/04
10,159,880 B1 * 12/2018 Mine ..... A63B 53/0466
10,279,230 B2 * 5/2019 Abe ..... A63B 53/0466
10,589,155 B2 * 3/2020 Hoffman ..... A63B 60/02
10,617,916 B2 * 4/2020 Milleman ..... A63B 53/0466
11,213,730 B2 * 1/2022 Sugimae ..... A63B 53/0408
2006/0240908 A1 * 10/2006 Adams ..... A63B 60/02 473/335
2010/0331103 A1 * 12/2010 Takahashi ..... A63B 53/0466 473/345
2012/0083360 A1 * 4/2012 Boyd ..... A63B 53/06 473/337
2013/0165251 A1 * 6/2013 Jorgensen ..... A63B 53/047 473/328
2013/0184094 A1 * 7/2013 Rauchholz ..... A63B 53/06 473/221
2015/0031470 A1 * 1/2015 Matsunaga ..... A63B 60/00 473/324
2015/0306473 A1 * 10/2015 Breier ..... A63B 53/06 473/409
2015/0306474 A1 * 10/2015 Breier ..... A63B 53/0466 473/332
2016/0008686 A1 * 1/2016 Jertson ..... A63B 53/0466 29/428
2017/0173419 A1 * 6/2017 Frame ..... A63B 53/06
2017/0173420 A1 * 6/2017 Frame ..... A63B 53/047
2018/0056154 A1 * 3/2018 Wallin ..... A63B 60/02
2022/0226699 A1 * 7/2022 Mizutani ..... A63B 53/0466
2024/0058663 A1 * 2/2024 Mizutani ..... A63B 53/0437

* cited by examiner

GOLF CLUB HEAD

CROSS REFERENCE TO RELATED APPLICATION

The present application claims priority to Japanese Patent Application No. 2022-129750 filed on Aug. 16, 2022. The entire contents of this Japanese Patent Application are hereby incorporated by reference.

BACKGROUND

Technical Field

The present disclosure relates to golf club heads.

Description of the Related Art

There has been known a golf club head to which a weight member is attached. JP2016-55109A discloses a golf club head that has a receiving hole formed on its sole portion and a weight member capable of being inserted into the receiving hole. In this head, the weight member is rotated in a clockwise direction to set the weight member at a lock position at which the weight member cannot be detached from the receiving hole.

SUMMARY

An adjustment member that is fixed to the outer surface of a head can be put to various uses. For example, various properties of a head can be adjusted by attaching, detaching or replacing such an adjustment member. Examples of adjustable properties of a head include aerodynamic properties of the head, the position of the center of gravity of the head, and the shape of the head.

The inventor of the present disclosure has found a new structure for fixing an adjustment member. This fixing structure enables the adjustment member to sandwich a head body and also allows the adjustment member to be retrofitted to a head.

One of the objects of the present disclosure is to provide a new fixing structure for a golf club head that includes an adjustment member fixed to the outer surface of the head.

In one aspect, a golf club head includes a head body that includes a body wall forming a head inner surface and a head outer surface, and at least one adjustment member that is detachably fixed to the head outer surface in a state where the body wall is sandwiched by the adjustment member. The head body has at least one opening that penetrates through the body wall. The adjustment member includes an inner portion that includes an inner surface abutment part that abuts against the head inner surface, an outer portion that includes an outer surface abutment part that abuts against the head outer surface, and a rotary connecting portion that connects the inner portion and the outer portion. Rotational positions of the inner portion include a pass-through position that allows the inner portion to pass through the opening, and a non-pass-through position that prevents the inner portion from passing through the opening. The inner surface abutment part situated at the non-pass-through position abuts against the head inner surface. The head body or the adjustment member includes a corotation prevention portion that prevents the inner portion situated at the non-pass-through position from corotating with the rotary connecting portion.

DESCRIPTION OF THE PREFERRED EMBODIMENTS

Hereinafter, embodiments will be described in detail with appropriate references to the accompanying drawings.

In the present disclosure, a reference state, a reference perpendicular plane, a toe-heel direction, a face-back direction, an up-down direction, and a face center are defined as follows.

Figure 32:
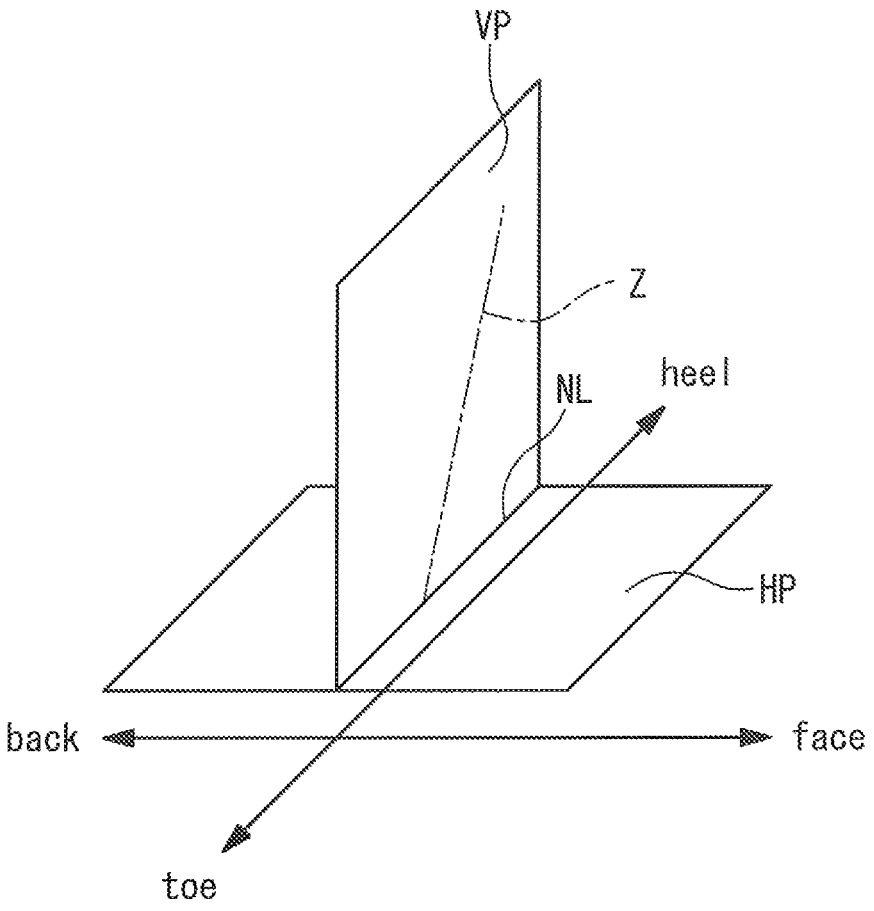
FIG. 32 is a conceptual diagram for illustrating a reference state.

The reference state is a state where a head is placed at a predetermined lie angle on a ground plane HP. As shown in FIG. 32, in the reference state, a shaft axis line Z lies on (is contained in) a plane VP that is perpendicular to the ground plane HP. The shaft axis line Z is the center line of a shaft. The shaft axis line Z usually coincides with the center line of a hosel hole. The plane VP is referred to as the reference perpendicular plane. The predetermined lie angle is shown in a product catalog, for example.

There has been known a club including a changing mechanism in which its loft angle, lie angle and face angle can be adjusted by changing a rotational position of a sleeve provided at a tip portion of a shaft. In a head used for such clubs, the shaft axis line Z of the head which is in the reference state is specified in a state where all adjustable items are set to be neutral. The term "neutral" means the center of the range of adjustment.

In the reference state, a face angle is 0°. That is, in a planar view of a head as viewed from above, a line normal to its hitting face at the face center is set to be perpendicular to the toe-heel direction. The definitions of the face center and the toe-heel direction are as explained below.

In the present disclosure, the toe-heel direction is the direction of an intersection line NL between the reference perpendicular plane VP and the ground plane HP (see FIG. 32).

In the present disclosure, the face-back direction is a direction that is perpendicular to the toe-heel direction and is parallel to the ground plane HP. A face side in the face-back direction is also simply referred to as "face side". A back side in the face-back direction is also simply referred to as "back side".

In the present disclosure, the up-down direction is a direction that is perpendicular to the toe-heel direction and is perpendicular to the face-back direction. In other words, the up-down direction in the present disclosure is a direction perpendicular to the ground plane HP.

In the present disclosure, the face center is determined in the following manner. First, a point Pr is selected roughly at the center of a hitting face in the up-down direction and the toe-heel direction. Next, a plane that passes through the point Pr, extends in the direction of a line normal to the hitting face at the point Pr, and is parallel to the toe-heel direction is determined. An intersection line between this plane and the hitting face is drawn, and a midpoint Px of this intersection line is determined. Next, a plane that passes through the midpoint Px, extends in the direction of a line normal to the hitting face at the midpoint Px, and is parallel to the up-down direction is determined. An intersection line between this plane and the hitting face is drawn, and a midpoint Py of this intersection line is determined. Next, a plane that passes through the midpoint Py, extends in the direction of a line normal to the hitting face at the midpoint Py, and is parallel to the toe-heel direction is determined. An intersection line between this plane and the hitting face is drawn, and a midpoint Px of this intersection line is newly determined. Next, a plane that passes through this newly-determined midpoint Px, extends in the direction of a line normal to the hitting face at this midpoint Px, and is parallel to the up-down direction is determined. An intersection line between this plane and the hitting face is drawn, and a midpoint Py of this intersection line is newly determined. By repeating the above-described steps, points Px and Py are sequentially determined. In the course of repeating these steps, when the distance between a newly-determined midpoint Py and a midpoint Py determined in the immediately preceding step first becomes less than or equal to 0.5 mm, the newly-determined midpoint Py (the midpoint Py determined last) is defined as the face center.

Hereinafter, a plurality of embodiments are explained. When a same member is used for different embodiments, a same reference symbol is used for the same member.

Figure 1:
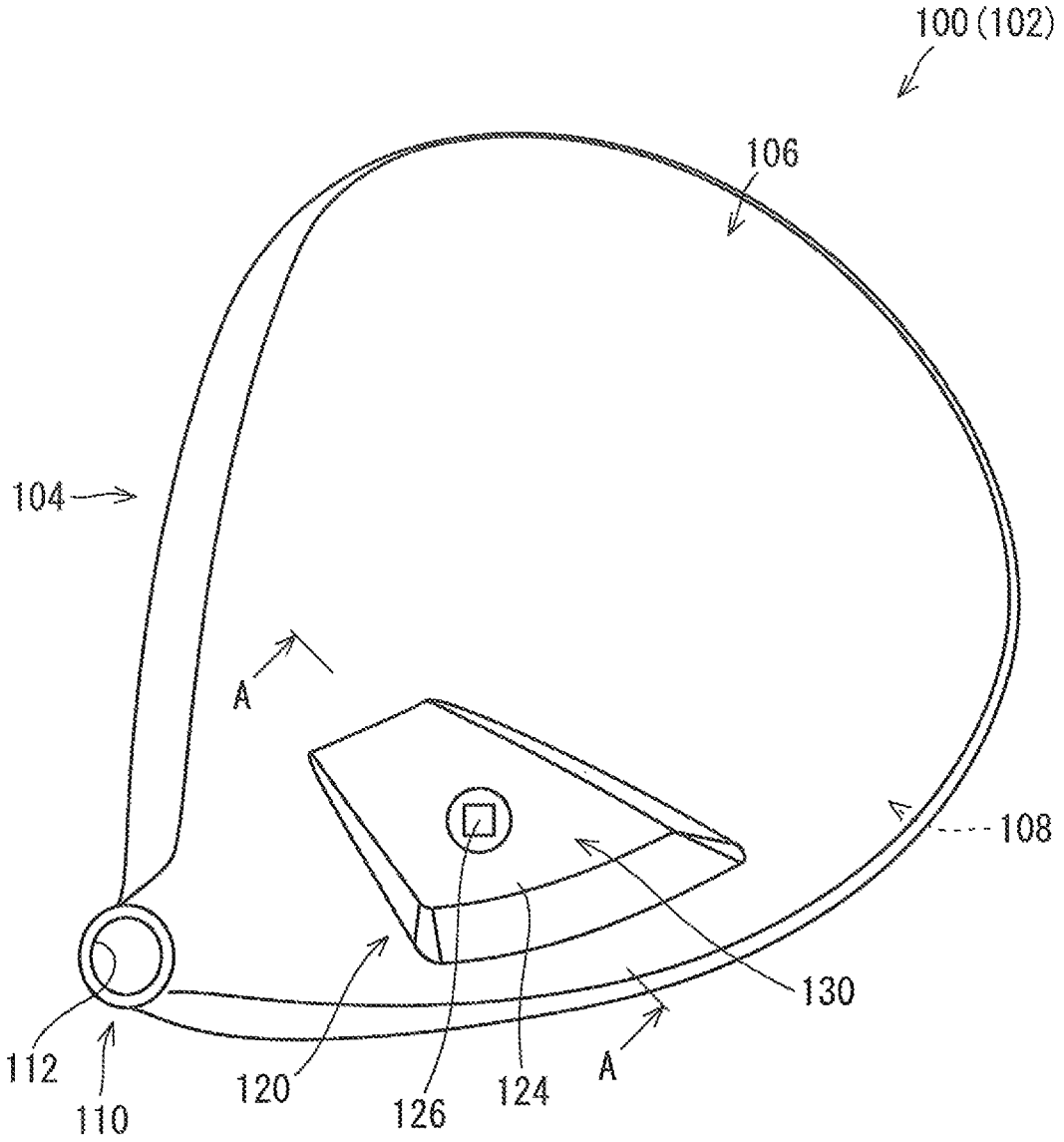
FIG. 1 is a perspective view of a golf club head according to a first embodiment.
Figure 2:
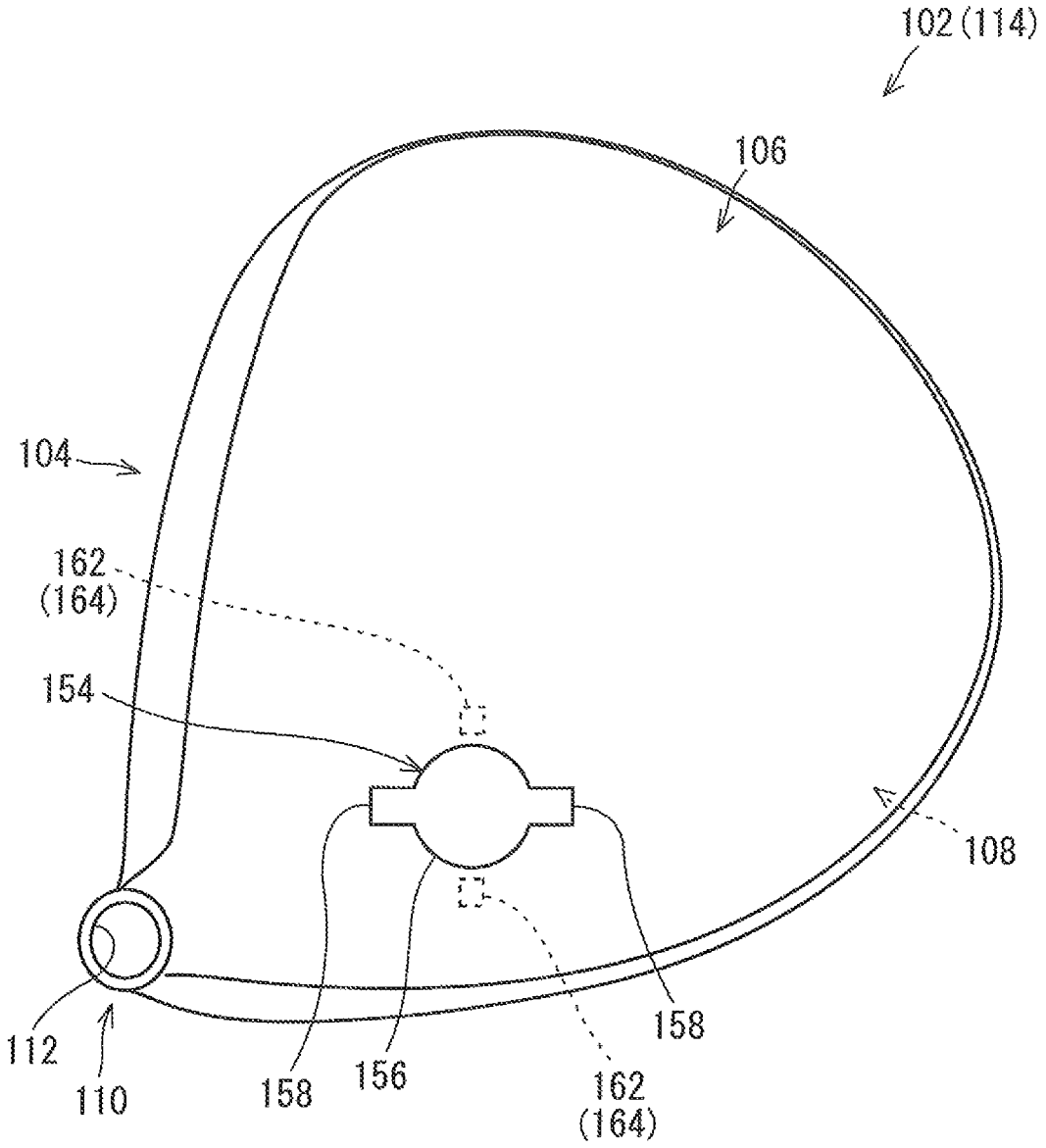
FIG. 2 is a perspective view of a head body of the head in FIG. 1.
Figure 3:
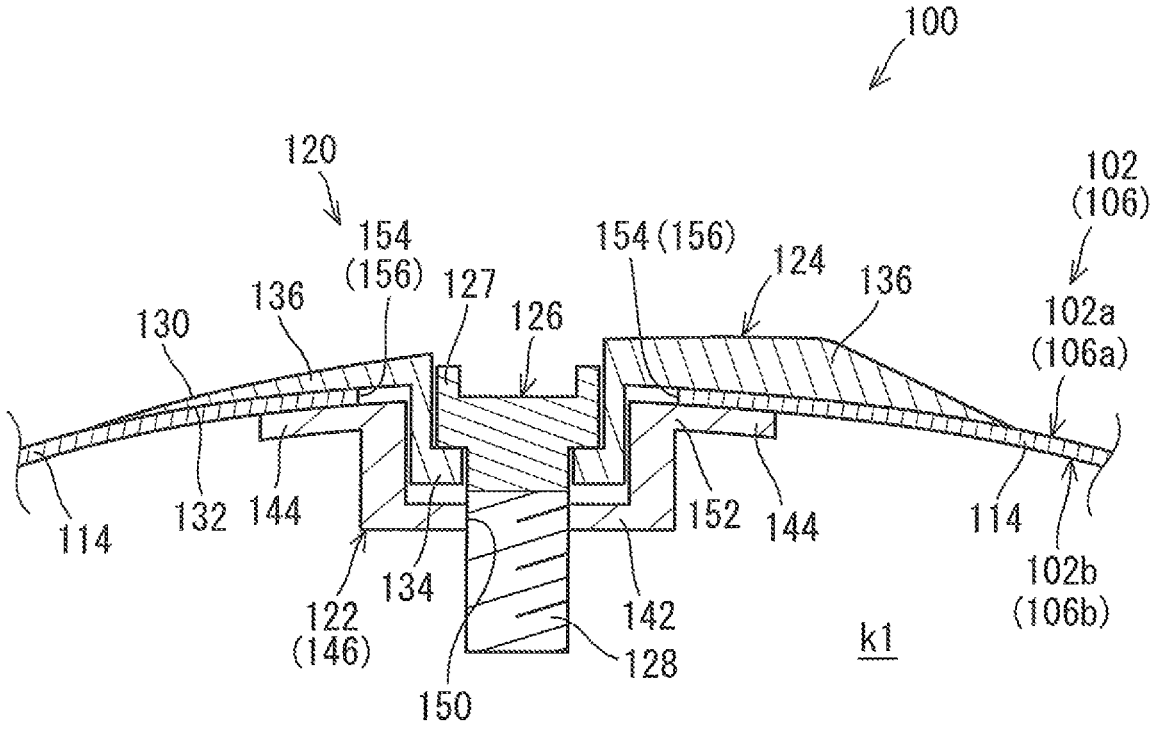
FIG. 3 is a cross-sectional view taken along line A-A in FIG. 1.

FIG. 1 is a perspective view of a head 100 according to a first embodiment. FIG. 2 is a perspective view of a head body 102. FIG. 3 is a cross-sectional view taken along line A-A in FIG. 1.

The head 100 includes a face portion 104, a crown portion 106, a sole portion 108, and a hosel portion 110. The hosel portion 110 has a hosel hole 112. The head 100 is hollow. The head body 102 has a head outer surface 102*a* and a head inner surface 102*b*. The head outer surface 102*a* includes a crown outer surface 106*a*. The head inner surface 102*b* includes a crown inner surface 106*b*. The head inner surface 102*b* faces a hollow interior kl of the head 100.

The head body 102 includes a body wall 114. The body wall 114 constitutes an outer shell of the head body 102. The outer surface of the body wall 114 is the head outer surface 102*a*. The inner surface of the body wall 114 is the head inner surface 102*b*.

The head 100 is a wood type head. The head 100 is a driver head. There is no limitation on the type of the head. The head 100 may be a hybrid type head, an iron type head, or a putter type head.

The head 100 includes an adjustment member 120. The adjustment member 120 is attached to the head body 102. The adjustment member 120 is attached to the body wall 114. The adjustment member 120 is attached to the head outer surface 102*a*. The adjustment member 120 is detachably fixed. The adjustment member 120 is fixed to the crown portion 106. The adjustment member 120 is attached on the heel side with respect to the face center. There is no limitation on the position of the adjustment member 120.

The adjustment member 120 includes an inner portion 122, an outer portion 124, and a rotary connecting portion 126. In the present embodiment, the rotary connecting portion 126 is a screw. The rotary connecting portion 126 includes a head part 127 and a screw part 128. The screw part 128 constitutes a male screw. The outer portion 124 is positioned on the outer side of the head 100 with respect to the inner portion 122. The outer portion 124 holds the rotary connecting portion 126 while allowing the rotary connecting portion 126 to freely rotate with respect to the outer portion 124. The inner portion 122 is screw-connected to the rotary connecting portion 126. The inner portion 122 is moved toward the outer portion 124 by tightening the rotary connecting portion 126, whereby the head body 102 is sandwiched between the inner portion 122 and the outer portion 124. As a result, the adjustment member 120 is fixed (hereinafter, this state is referred to as a fixed state).

The adjustment member 120 is a separate member from the head body 102. The inner portion 122 is a separate member from the outer portion 124 and the rotary connecting portion 126. The outer portion 124 is a separate member from the inner portion 122 and the rotary connecting portion 126. Note that, alternatively, the outer portion 124 and the rotary connecting portion 126 may be integrally formed as a single-piece member as described below.

Figure 4A:
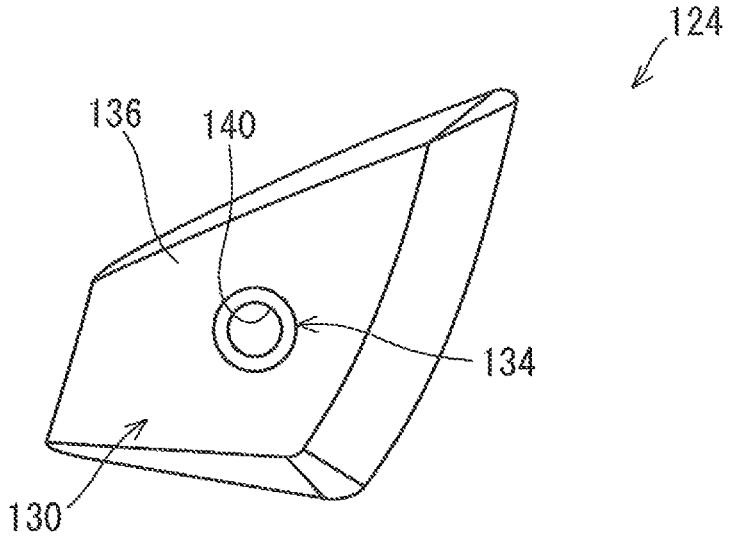
FIG. 4A is a plan view of an outer portion of an adjustment member according to the first embodiment.
Figure 4B:
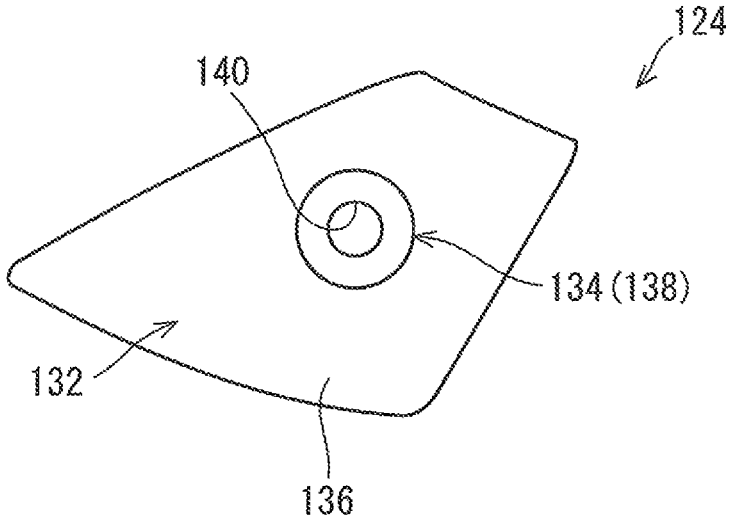
FIG. 4B is a bottom view of the outer portion.
Figure 4C:
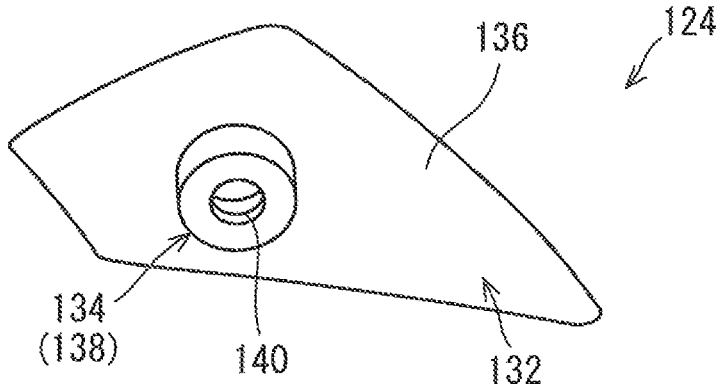
FIG. 4C is a perspective view of the outer portion as viewed from its bottom side.

FIG. 4A is a plan view of the outer portion 124. FIG. 4B is a bottom view of the outer portion 124. FIG. 4C is a perspective view of the outer portion 124. FIG. 4C is the perspective view of the outer portion 124 as viewed from its bottom side.

The outer portion 124 includes an upper surface 130 and a bottom surface 132. When the adjustment member 120 is in the fixed state, the upper surface 130 is exposed to the outside of the head 100. When the adjustment member 120 is in the fixed state, the bottom surface 132 faces the head outer surface 102*a*.

The outer portion 124 includes a boss part 134. The boss part 134 includes a cylinder part 138 and a through hole 140 formed in the bottom part of the cylinder part 138. The head part 127 of the rotary connecting portion 126 is disposed inside the cylinder part 138. The through hole 140 has an inner diameter through which the head part 127 cannot pass. The boss part 134 protrudes from the bottom surface 132 of the outer portion 124 (see FIG. 4C). The screw part 128 of the rotary connecting portion 126 is inserted into the through hole 140. The through hole 140 is not screw-connected with the screw part 128. The boss part 134 holds the rotary connecting portion 126 while allowing the rotary connecting portion 126 to freely rotate with respect to the boss part 134.

The outer portion 124 includes an outer surface abutment part 136. When the adjustment member 120 is in the fixed state, the outer surface abutment part 136 abuts against the head outer surface 102*a*. In the present embodiment, of the outer portion 124, a part excluding the boss part 134 is the outer surface abutment part 136.

Figure 5A:
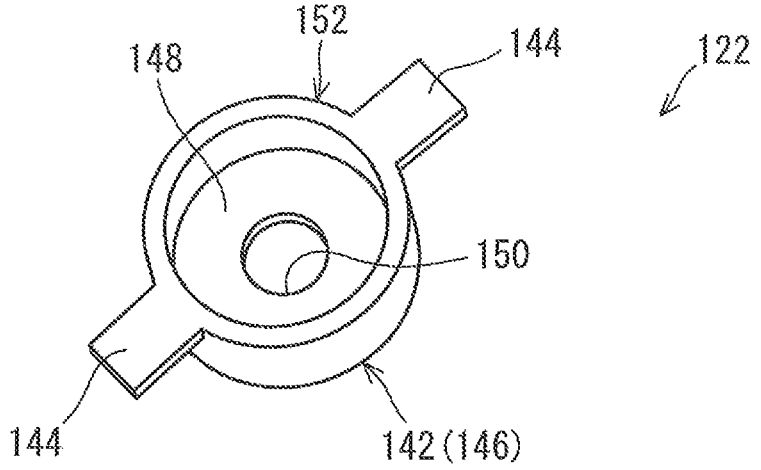
FIG. 5A is a perspective view of an inner portion of the adjustment member according to the first embodiment.
Figure 5B:
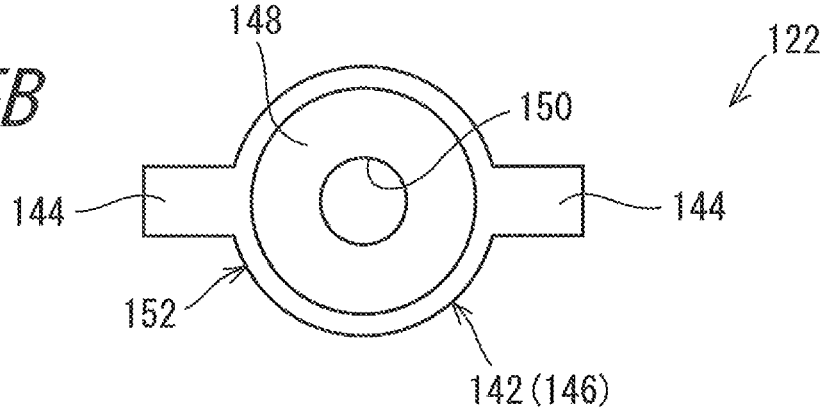
FIG. 5B is a plan view of the inner portion.
Figure 5C:
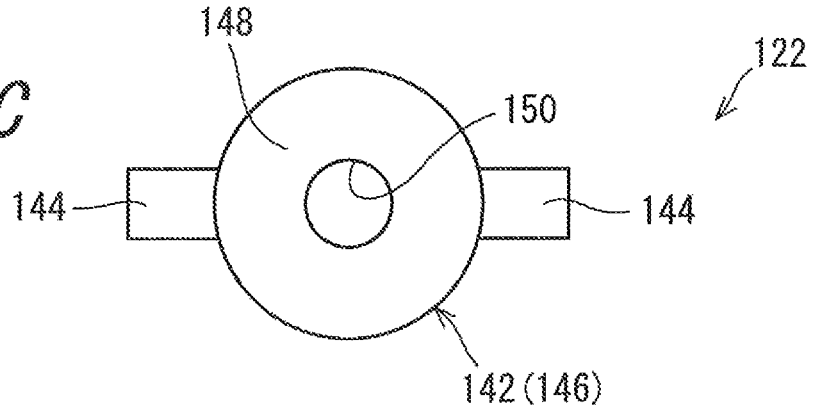
FIG. 5C is a bottom view of the inner portion.
Figure 5D:
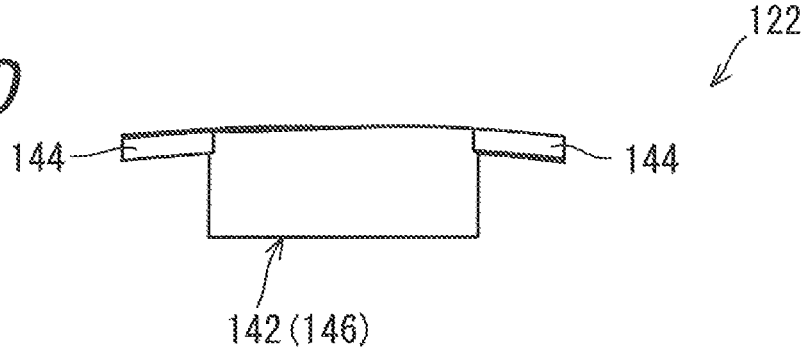
FIG. 5D is a side view of the inner portion.

FIG. 5A is a perspective view of the inner portion 122. FIG. 5B is a plan view of the inner portion 122. FIG. 5C is a bottom view of the inner portion 122. FIG. 5D is a side view of the inner portion 122.

The inner portion 122 includes a base part 142 and an outward extending part 144. The base part 142 includes a cylindrical part 146, a bottom part 148 and a screw hole 150. The outward extending part 144 extends outward from the outer edge part (cylindrical part 146) of the base part 142. A plurality of (two) outward extending parts 144 are provided at separate positions in the circumferential direction of the base part 142. The screw hole 150 constitutes a female screw. The screw hole 150 is screw-connected with the screw part 128.

The inner portion 122 includes an inner surface abutment part 152. When the adjustment member 120 is in the fixed state, the inner surface abutment part 152 abuts against the head inner surface 102*b*. In the present embodiment, (the upper end surface of) the cylindrical part 146 and the outward extending parts 144 constitute the inner surface abutment part 152.

As shown in FIG. 2, an opening 154 is formed in the body wall 114 of the head body 102. The opening 154 penetrates through the body wall 114. The shape of the opening 154 corresponds to the shape of the inner portion 122 in a planar view (see FIG. 5B). The opening 154 includes a circular part 156 and outward extending parts 158 that extend outward from the circular part 156.

As shown in FIG. 3, when the adjustment member 120 is in the fixed state, the inner portion 122 which is screw-connected to the screw part 128 is moved toward the outer portion 124 by rotating the rotary connecting portion 126. By further tightening the rotary connecting portion 126, the body wall 114 is sandwiched between the inner portion 122 and the outer portion 124, whereby the adjustment member 120 is fixed. The body wall 114 is sandwiched between the outer surface abutment part 136 of the outer portion 124 and the inner surface abutment part 152 of the inner portion 122.

The boss part 134 of the outer portion 124 is inserted into the base part 142 (cylindrical part 146) of the inner portion 122. The outer diameter of the boss part 134 corresponds to the inner diameter of the cylindrical part 146. The inner portion 122 can rotate about the boss part 134. Thus, the base part 142 has a shape that allows the inner portion 122 to rotate about the boss part 134 in a state where the boss part 134 is inserted into the base part 142. As described below, when the rotary connecting portion 126 is rotated, the inner portion 122 can corotate with the rotary connecting portion 126.

The diameter of the circular part 156 of the opening 154 corresponds to the outer diameter of the cylindrical part 146 of the inner portion 122. As described below, the inner portion 122 can pass through the opening 154.

Figure 6:
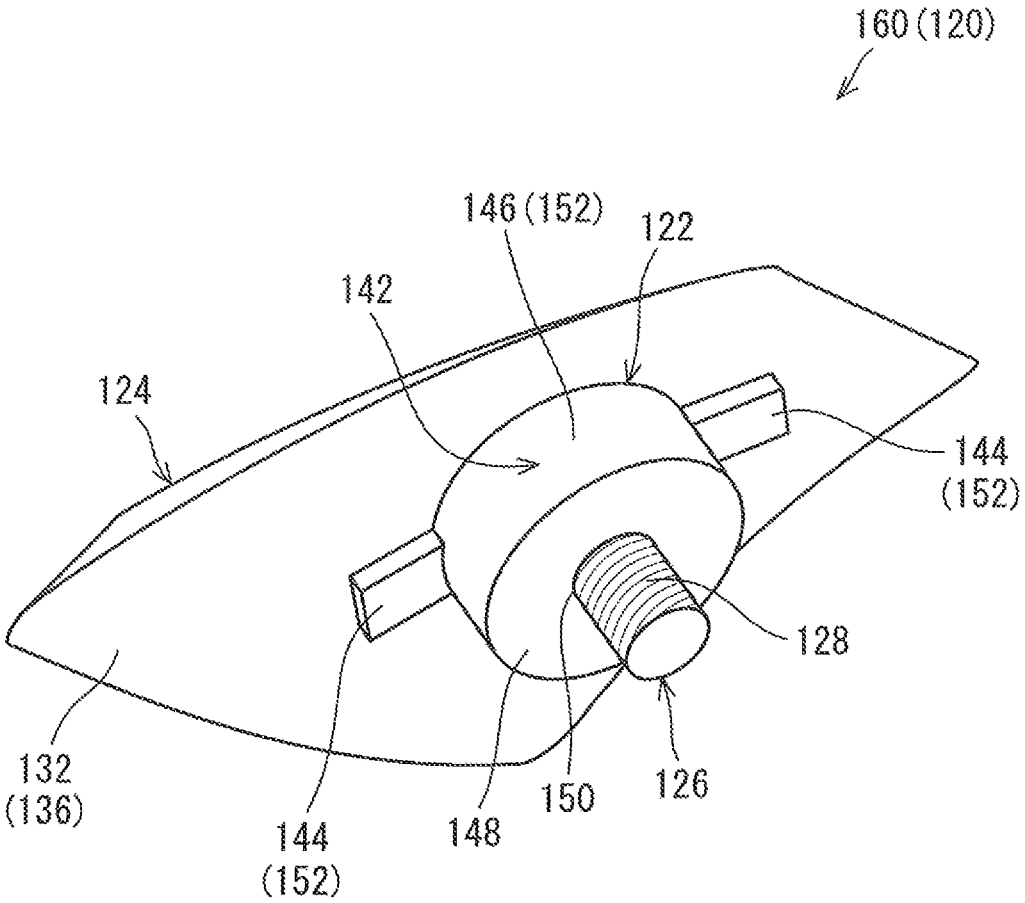
FIG. 6 is a perspective view of an assembly in which the adjustment member of the first embodiment is assembled.

FIG. 6 is a perspective view of an assembly 160 in which all components constituting the adjustment member 120 are assembled. Relationships among the components in the assembly 160 are the same as those in the adjustment member 120 which is in the fixed state. The adjustment member 120 is attached to the head body 102 in the state of the assembly 160. The adjustment member 120 can be retrofitted to the head body 102. The adjustment member 120 can be attached to the head body 102 from the outside of the head body 102. The adjustment member 120 can be detached from the outside of the head body 102.

Figure 7:
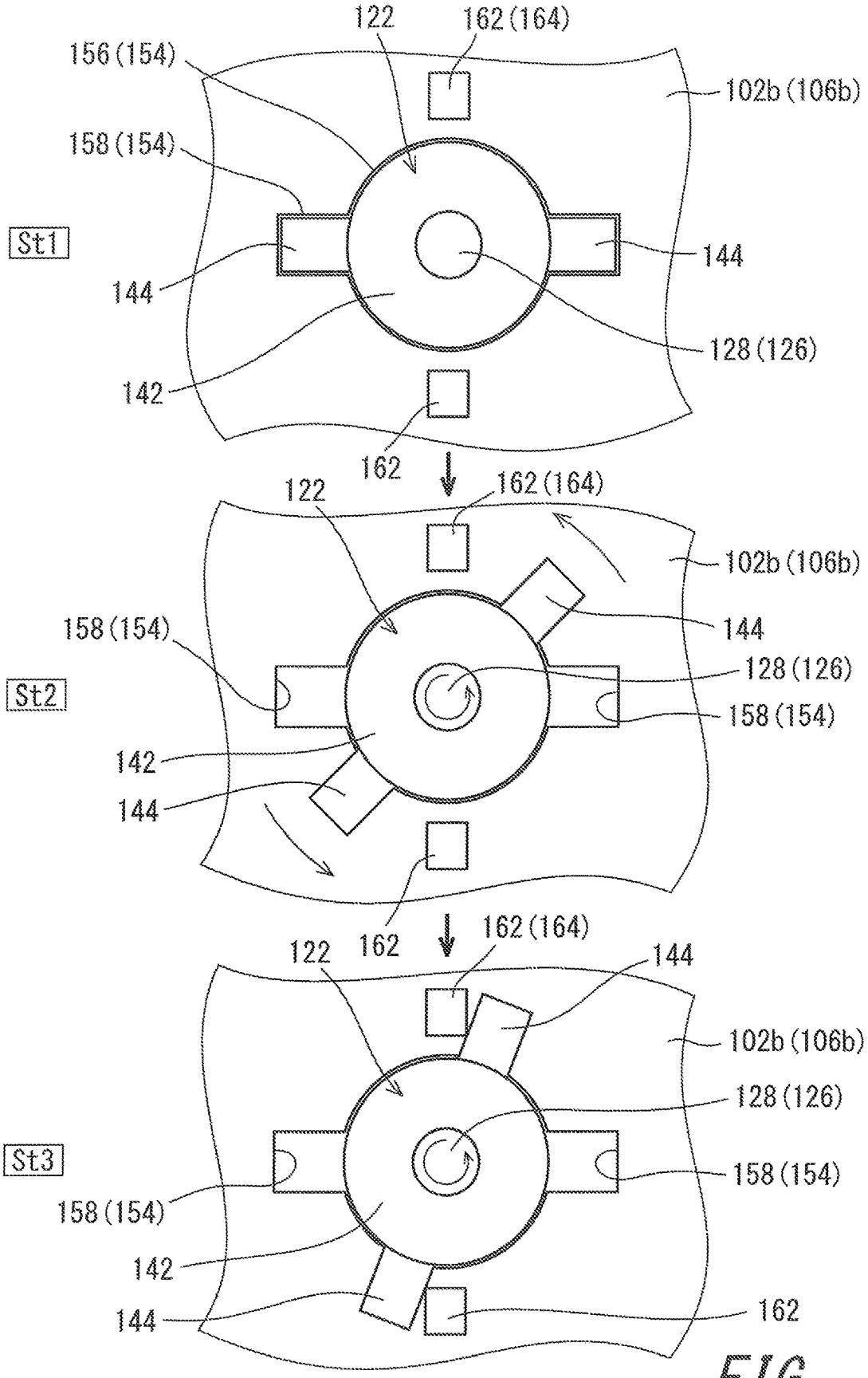
FIG. 7 is a diagram, as viewed from the inside of the head, showing the process of inserting and fixing the adjustment member of the first embodiment to the head body.

FIG. 7 is a diagram for illustrating a method of attaching the adjustment member 120. FIG. 7 shows a part of the head 100 (head body 102) as viewed from its inside (hollow interior kl side).

The head body 102 includes corotation prevention portions 162 on the head inner surface 102*b* (see FIG. 7 and FIG. 2). The corotation prevention portions 162 are protrusions that protrude from the head inner surface 102*b* toward the inside of the head 100. These protrusions are also referred to as corotation prevention protrusions. These corotation prevention protrusions are body protrusions 164 provided on the body wall 114.

For attaching the adjustment member 120, the assembly 160 (FIG. 6) is first prepared. In this assembly 160, a gap should be left between the inner surface abutment part 152 of the inner portion 122 and the outer surface abutment part 136 of the outer portion 124 so as to sandwich the body wall 114 between the inner surface abutment part 152 and the outer surface abutment part 136.

Next, the inner portion 122 of the assembly 160 is inserted into the opening 154 (step St1). This inserting step is conducted while mating the angular position of the inner portion 122 in its rotational direction with the angular position of the opening 154 in its circumferential direction. That is, the inner portion 122 is rotated to a rotational position so that the inner portion 122 can pass through the opening 154. The rotational position of the inner portion 122 at which the inner portion 122 can pass through the opening 154 is referred to as a pass-through position. The upper-most drawing in FIG. 7 shows a state in which the inner portion 122 has passed through the opening 154 as viewed from the inside of the head 100. At this time, the inner portion 122 is positioned inside the head body 102.

Next, the rotary connecting portion 126 is rotated in a tightening direction (step St2). At this time, the inner portion 122 corotates together with the rotary connecting portion 126. As these portions further corotate together, the outward extending parts 144 of the inner portion 122 move closer to the respective body protrusions 164 (corotation prevention portions 162).

Next, the outward extending parts 144 abut against the respective body protrusions 164 (corotation prevention portions 162) (step St3). This abutment prevents further corotation of the inner portion 122 with the rotary connecting portion 126. The rotary connecting portion 126 is further rotated in the tightening direction in the state where the corotation is prevented. In this rotation, the rotary connecting portion 126 is rotated without rotation of the inner portion 122, and thus the screw is tightened. As a result, the rotary connecting portion 126 is completely tightened to attain the fixed state (FIG. 3).

For detaching the adjustment member 120, the rotary connecting portion 126 is rotated in the reverse direction to the tightening direction. The inner portion 122 can corotate together with the rotary connecting portion 126. Further rotation of the rotary connecting portion 126, however, causes the inner portion 122 to abut against the body protrusions 164 (corotation prevention portions 162) whereby further corotation is prevented. Accordingly, the rotary connecting portion 126 can be loosened. After loosening the rotary connecting portion 126, the rotational position of the inner portion 122 is adjusted to the pass-through position, and then the inner portion 122 is passed through the opening 154. As a result, the assembly 160 can be separated from the head body 102, and the detachment of the adjustment member 120 is accomplished.

When the inner portion 122 begins to rotate in the step St2, the rotational position of the inner portion 122 is shifted to a non-pass-through position at which the inner portion 122 cannot pass through the opening 154. When the outward extending parts 144 abut against the body protrusions 164, the rotational position of the inner portion 122 is the non-pass-through position. In the present embodiment, all rotational positions except the pass-through position are the non-pass-through positions. When the inner portion 122 is at the non-pass-through position, the inner portion 122 can abut against the head inner surface 102*b*. When the inner portion 122 is at the non-pass-through position, the body wall 114 can be sandwiched between the inner portion 122 and the outer portion 124.

Figure 8:
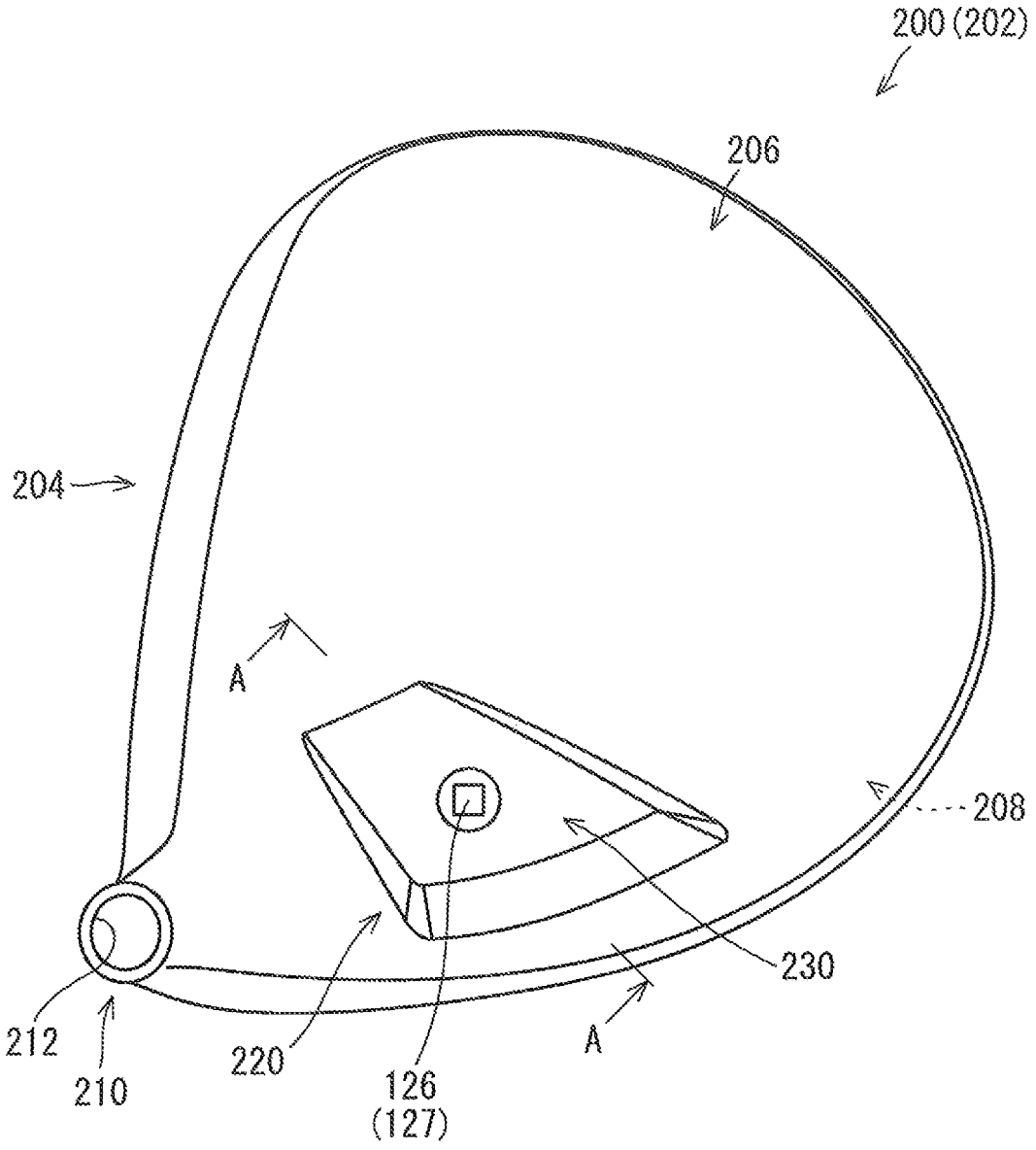
FIG. 8 is a perspective view of a golf club head according to a second embodiment.
Figure 9:
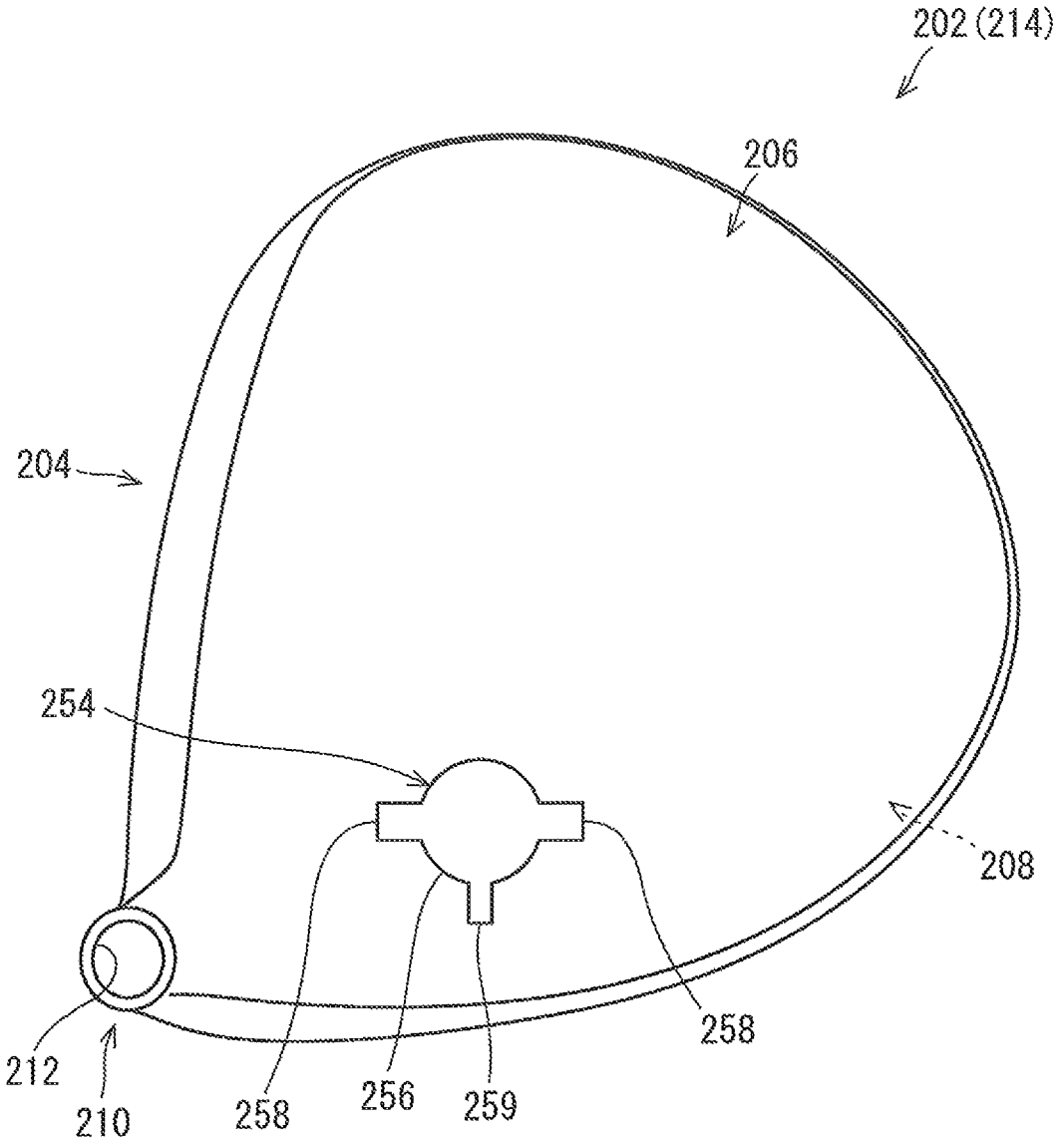
FIG. 9 is a perspective view of a head body of the head of the second embodiment.

FIG. 8 is a perspective view of a head 200 according to a second embodiment. FIG. 9 is a perspective view of a head body 202.

The head 200 includes a face portion 204, a crown portion 206, a sole portion 208, and a hosel portion 210. The hosel portion 210 has a hosel hole 212. Th head 200 is hollow. The head 200 includes an adjustment member 220.

Figure 10A:
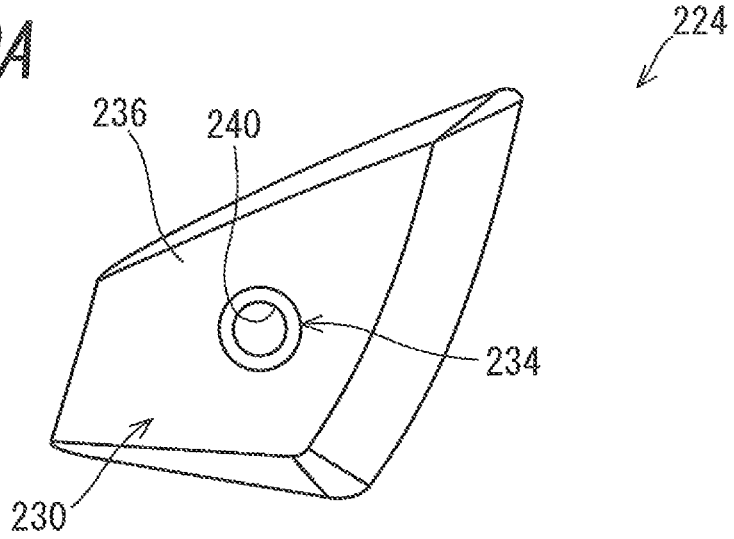
FIG. 10A is a plan view of an outer portion of an adjustment member according to the second embodiment.
Figure 10B:
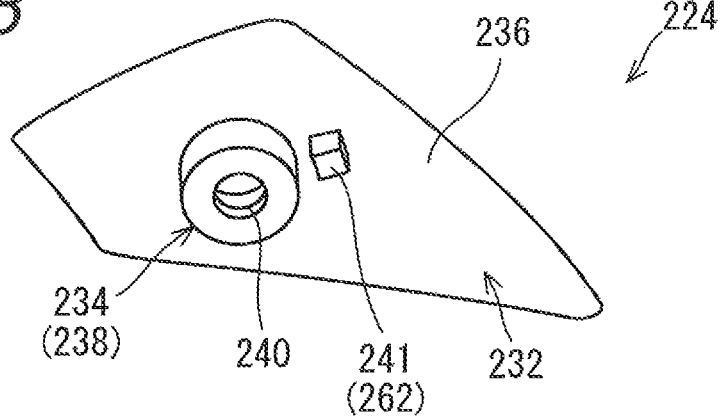
FIG. 10B is a perspective view of the outer portion as viewed from its bottom side.
Figure 11:
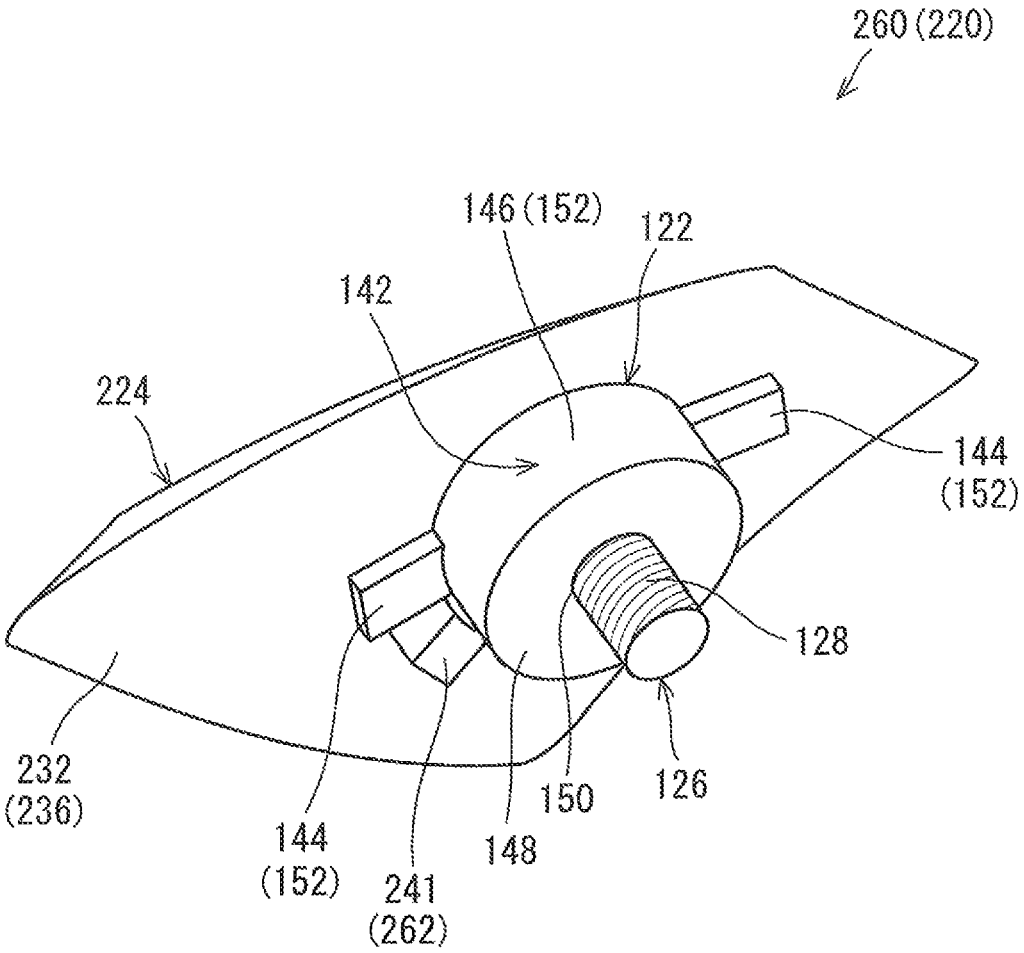
FIG. 11 is a perspective view of an assembly in which the adjustment member of the second embodiment is assembled.

FIG. 10A is a plan view of an outer portion 224 used in the adjustment member 220. FIG. 10B is a perspective view of the outer portion 224 as viewed from its bottom side. FIG. 11 is a perspective view of an assembly 260 in which the adjustment member 220 is assembled.

The adjustment member 220 (assembly 260) includes an inner portion 122, the outer portion 224 and a rotary connecting portion 126. The rotary connecting portion 126 includes a head part 127 (see FIG. 8) and a screw part 128 (see FIG. 11).

The outer portion 224 includes an upper surface 230 and a bottom surface 232. When the adjustment member 220 is in the fixed state, the upper surface 230 is exposed to the outside of the head 200. When the adjustment member 220 is in the fixed state, the bottom surface 232 faces the head outer surface (crown outer surface). The outer portion 224 includes a boss part 234 (see FIG. 10B). The boss part 234 includes a cylinder part 238 and a through hole 240 formed in the bottom part of the cylinder part 238. The head part 127 of the rotary connecting portion 126 is disposed inside the cylinder part 238. The through hole 240 has an inner diameter through which the head part 127 cannot pass. The boss part 234 protrudes from the bottom surface 232 of the outer portion 224 (see FIG. 10B). The screw part 128 of the rotary connecting portion 126 is inserted into the through hole 240. The through hole 240 is not screw-connected with the screw part 128. The boss part 234 holds the rotary connecting portion 126 while allowing the rotary connecting portion 126 to freely rotate with respect to the boss part 234.

The outer portion 224 includes an outer surface abutment part 236. When the adjustment member 220 is in the fixed state, the outer surface abutment part 236 abuts against the head outer surface (crown outer surface). In the present embodiment, of the outer portion 224, a part excluding the boss part 234 and a penetrating protrusion 241 is the outer surface abutment part 236.

The outer portion 224 includes the penetrating protrusion 241. The penetrating protrusion 241 protrudes from the outer surface abutment part 236 (bottom surface 232). When the adjustment member 220 is in the fixed state, the penetrating protrusion 241 penetrates through a body wall 214 of the head body 202 and protrudes from the head inner surface toward the inside of the head 200. Except for the presence of the penetrating protrusion 241, the outer portion 224 is the same as the outer portion 124 of the first embodiment.

The inner portion 122 is the same as the inner portion 122 of the first embodiment (FIG. 5A to FIG. 5D). The inner portion 122 includes a base part 142 and an outward extending part 144. The base part 142 includes a cylindrical part 146, a bottom part 148 and a screw hole 150. The outward extending part 144 extends outward from the outer edge part (cylindrical part 146) of the base part 142. A plurality of (two) outward extending parts 144 are provided at separate positions in the circumferential direction of the base part 142. The screw hole 150 constitutes a female screw. The screw hole 150 is screw-connected with the screw part 128 of the rotary connecting portion 126. The inner portion 122 includes an inner surface abutment part 152. When the adjustment member 220 is in the fixed state, the inner surface abutment part 152 abuts against the head inner surface (crown inner surface). In the present embodiment, the cylindrical part 146 and the outward extending parts 144 constitute the inner surface abutment part 152.

A cross-sectional view showing the fixed state in the second embodiment (cross-sectional view taken along line A-A in FIG. 8) is the same as FIG. 3 of the first embodiment.

As shown in FIG. 9, an opening 254 is formed in the body wall 214 of the head body 202. The opening 254 penetrates through the body wall 214. The opening 254 includes a circular part 256, outward extending parts 258 that extend outward from the circular part 256, and a supplementary opening 259. A shape that is formed by the circular part 256 and the outward extending parts 258 corresponds to the shape of the inner portion 122 in the planar view. The supplementary opening 259 is continuous with the opening 254 (circular part 256). The supplementary opening 259 is formed at a position different from the positions of the outward extending parts 258. The penetrating protrusion 241 penetrates through the supplementary opening 259.

In the present embodiment, the supplementary opening 259 is formed continuously with the opening 254. The supplementary opening 259 does not have to be continuous with the opening 254. The supplementary opening 259 may be positioned apart from the opening 254.

Figure 12:
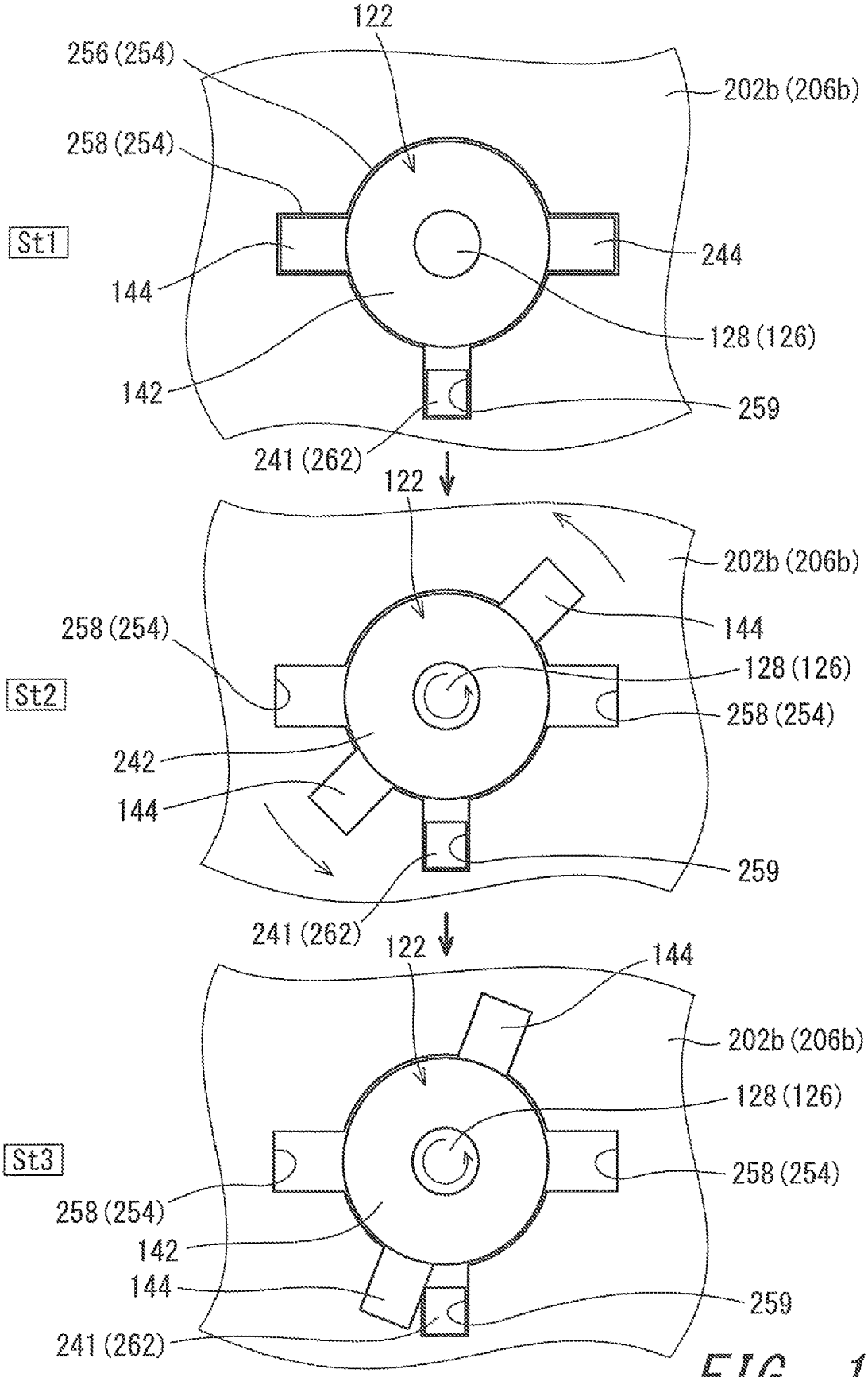
FIG. 12 is a diagram, as viewed from the inside of the head, showing the process of inserting and fixing the adjustment member of the second embodiment to the head body.

FIG. 12 is a diagram for illustrating a method of attaching the adjustment member 220. FIG. 12 shows a part of the head 200 (head body 202) as viewed from its inside.

The head body 202 has a head inner surface 202*b*. The head inner surface 202*b* includes a crown inner surface 206*b*. In the first embodiment described above, the head body 102 (body wall 114) includes the body protrusions 164 protruding from the head inner surface 102*b*. On the other hand, in the second embodiment, the head body 202 does not include a body protrusion. As described above, in the second embodiment, the outer portion 224 includes the penetrating protrusion 241. The penetrating protrusion 241 penetrates through the body wall 214 and protrudes from the head inner surface 202*b* toward the inside of the head 200. The penetrating protrusion 241 is a corotation prevention portion 262. This protrusion 241 is also referred to as a corotation prevention protrusion.

For attaching the adjustment member 220, the assembly 260 (FIG. 11) is first prepared. In this assembly 260, a gap should be left between the inner surface abutment part 152 of the inner portion 122 and the outer surface abutment part 236 of the outer portion 224 so as to sandwich the body wall 214 between the inner surface abutment part 152 and the outer surface abutment part 236.

Next, the inner portion 122 of the assembly 260 is inserted into the opening 254 (step St1). This inserting step is conducted while adjusting the rotational position of the inner portion 122 so that the inner portion 122 can pass through the opening 254. That is, the inner portion 122 is adjusted to the pass-through position. In addition, the rotational position of the outer portion 224 is adjusted so that the penetrating protrusion 241 can pass through the supplementary opening 259. The upper-most drawing in FIG. 12 shows a state in which the inner portion 122 has passed through the opening 254 and the penetrating protrusion 241 has passed through the supplementary opening 259, as viewed from the inside of the head 200. At this time, the inner portion 122 is positioned inside the head body 202. At the same time, the penetrating protrusion 241 protrudes from the head inner surface 202*b* toward the inside of the head 200.

Next, the rotary connecting portion 126 is rotated in the tightening direction (step St2). At this time, the inner portion 122 corotates together with the rotary connecting portion 126. As these portions further corotate together, one of the outward extending parts 144 of the inner portion 122 moves closer to the penetrating protrusion 241 (corotation prevention portion 262).

Next, the one of the outward extending parts 144 abuts against the penetrating protrusion 241 (step St3). This abutment prevents further corotation of the inner portion 122 with the rotary connecting portion 126. The rotary connecting portion 126 is further rotated in the tightening direction in the state where the corotation is prevented. In this rotation, the rotary connecting portion 126 is rotated without rotation of the inner portion 122, and thus the screw is tightened. As a result, the rotary connecting portion 126 is completely tightened to attain the fixed state.

Also in the second embodiment, the corotation of the inner portion 122 is prevented. In the second embodiment, a body protrusion 164 does not have to be provided, and the supplementary opening 259 is formed instead. Accordingly, forming the head body 202 becomes easier. In addition, the penetrating protrusion 241 can be easily formed by using a material excellent in formability to form the outer portion 224. Furthermore, the engagement between the supplementary opening 259 and the penetrating protrusion 241 can accurately determine the rotational position of the outer portion 224. Accordingly, the outer portion 224 is attached with higher accuracy. The outer portion 224 is not screw-connected to the rotary connecting portion 126, but the outer portion 224 can corotate together with the rotary connecting portion 126 because of frictional force. The engagement between the supplementary opening 259 and the penetrating protrusion 241 can prevent the corotation of the outer portion 224 with the rotary connecting portion 126.

Figure 13:
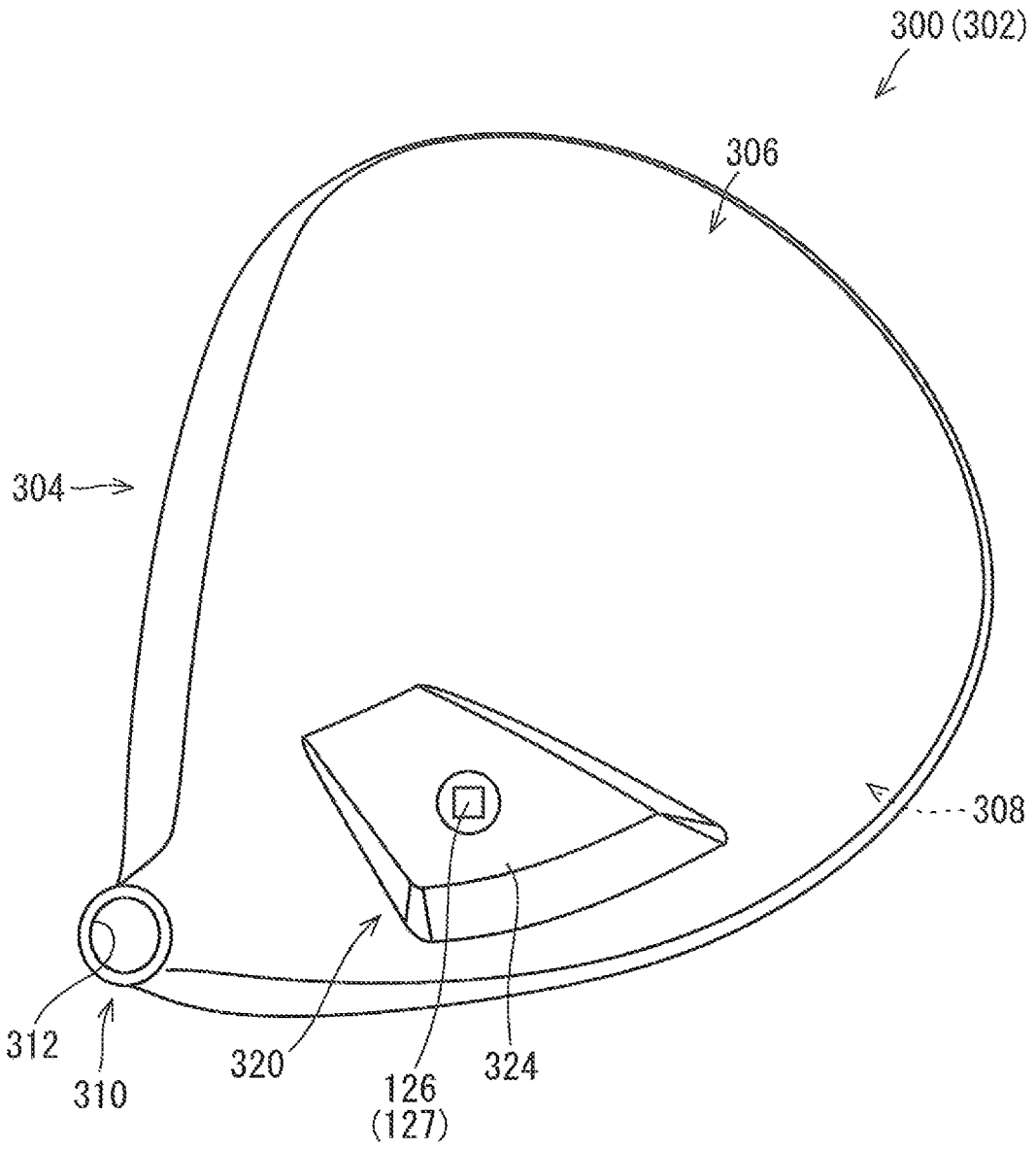
FIG. 13 is a perspective view of a golf club head according to a third embodiment.
Figure 14:
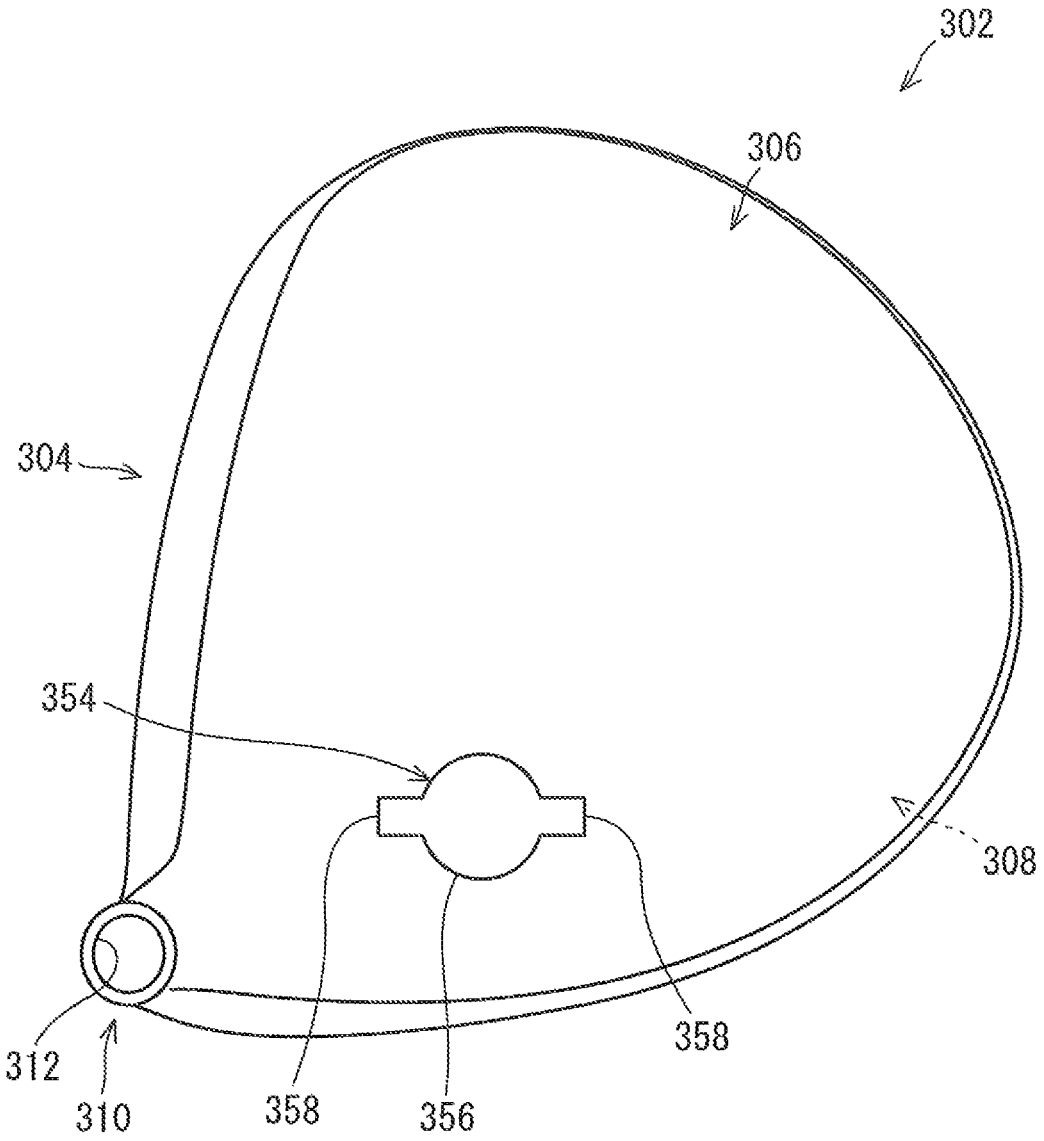
FIG. 14 is a perspective view of a head body of the head of the third embodiment.

FIG. 13 is a perspective view of a head 300 according to a third embodiment. FIG. 14 is a perspective view of a head body 302 of the head 300.

The head 300 includes a face portion 304, a crown portion 306, a sole portion 308, and a hosel portion 310. The hosel portion 310 has a hosel hole 312. The head 300 is hollow. The head 300 includes an adjustment member 320.

The adjustment member 320 includes an inner portion 322, an outer portion 324, and a rotary connecting portion 126. The rotary connecting portion 126 is the same as the rotary connecting portion 126 of the first embodiment.

As shown in FIG. 14, an opening 354 is formed in the head body 302. The shape of the opening 354 corresponds to the shape of the inner portion 322 in a planar view (see FIG. 16B). The opening 354 includes a circular part 356 and outward extending parts 358 that extend outward from the circular part 356.

Figure 15A:
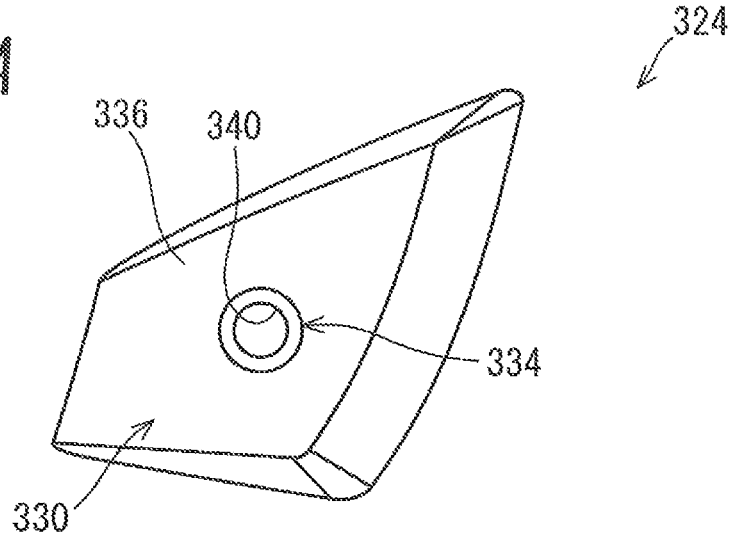
FIG. 15A is a plan view of an outer portion of an adjustment member according to the third embodiment.
Figure 15B:
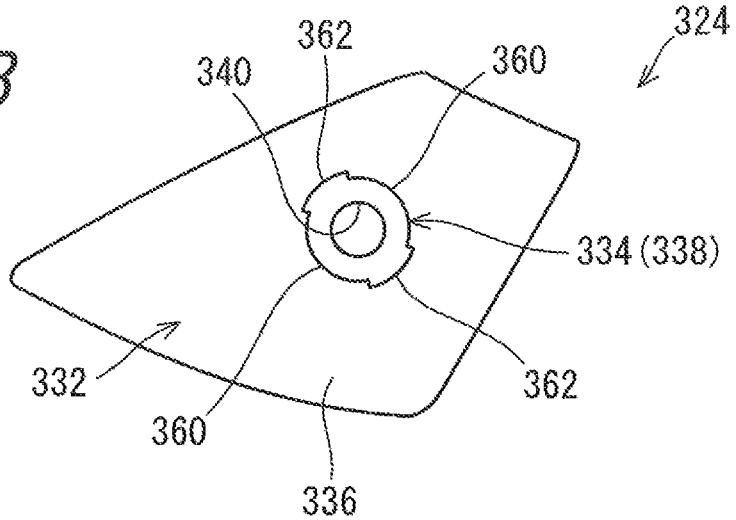
FIG. 15B is the bottom view of the outer portion.
Figure 15C:
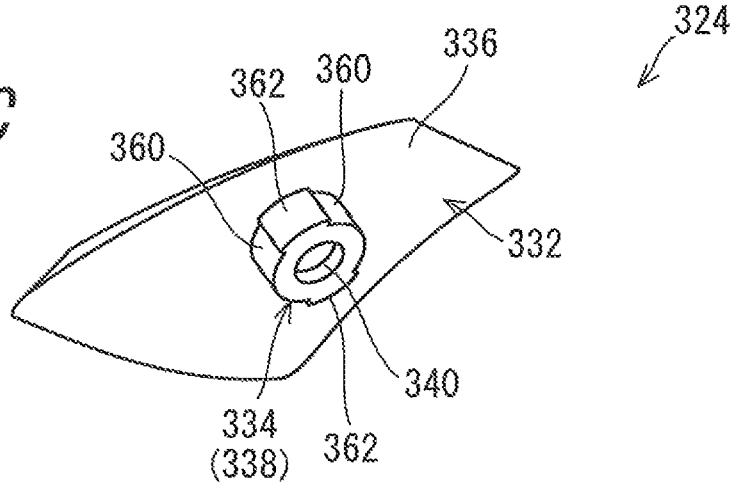
FIG. 15C is a perspective view of the outer portion as viewed from its bottom side.

FIG. 15A is a plan view of the outer portion 324. FIG. 15B is a bottom view of the outer portion 324. FIG. 15C is a perspective view of the outer portion 324 as viewed from its bottom side.

The outer portion 324 includes an upper surface 330 and a bottom surface 332. When the adjustment member 320 is in the fixed state, the upper surface 330 is exposed to the outside of the head 300. When the adjustment member 320 is in the fixed state, the bottom surface 332 faces the head outer surface (crown outer surface). The outer portion 324 includes a boss part 334. The boss part 334 includes a cylinder part 338 and a through hole 340 formed in the bottom part of the cylinder part 338. The head part 127 of the rotary connecting portion 126 is disposed inside the cylinder part 338. The through hole 340 has an inner diameter through which the head part 127 cannot pass. The boss part 334 protrudes from the bottom surface 332 of the outer portion 324 (see FIG. 15C). The screw part 128 of the rotary connecting portion 126 is inserted into the through hole 340. The through hole 340 is not screw-connected with the screw part 128. The boss part 334 holds the rotary connecting portion 126 while allowing the rotary connecting portion 126 to freely rotate with respect to the boss part 334.

The outer portion 324 includes an outer surface abutment part 336. When the adjustment member 320 is in the fixed state, the outer surface abutment part 336 abuts against the head outer surface (crown outer surface). In the present embodiment, of the outer portion 324, a part excluding the boss part 334 is the outer surface abutment part 336.

The outer circumferential surface of the boss part 334 includes a smaller-diameter part 360 and a larger-diameter part 362. The larger-diameter part 362 constitutes a protrusion that protrudes outward in the radial direction of the boss part 334. Two larger-diameter parts 362 (protrusions) are formed at separate positions in the circumferential direction of the boss part 334. The two larger-diameter parts 362 are arranged at equal intervals (intervals of 180°) in the circumferential direction. Alternatively, the number of the larger-diameter parts 362 (protrusions) may be one.

Figure 16A:
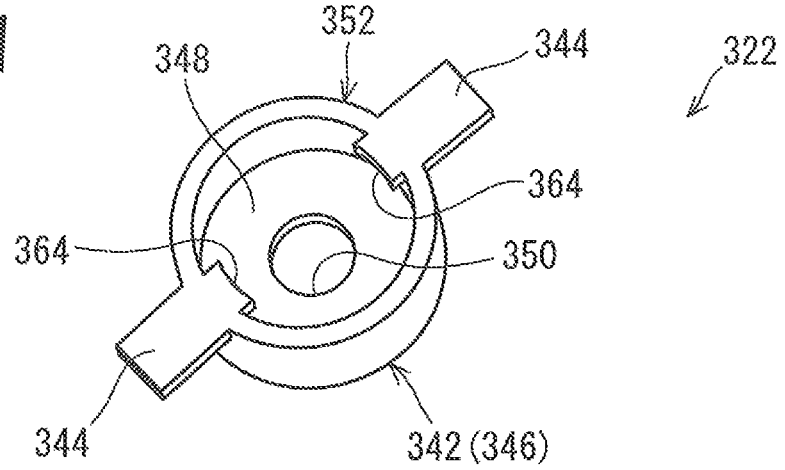
FIG. 16A is a perspective view of an inner portion of the adjustment member according to the third embodiment.
Figure 16B:
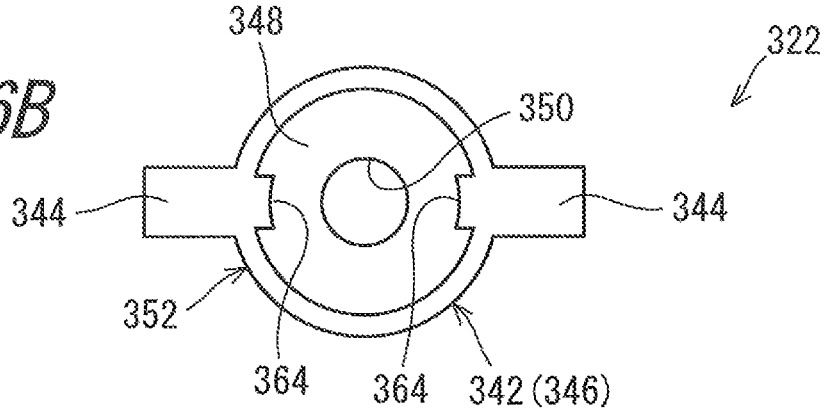
FIG. 16B is a plan view of the inner portion.
Figure 16C:
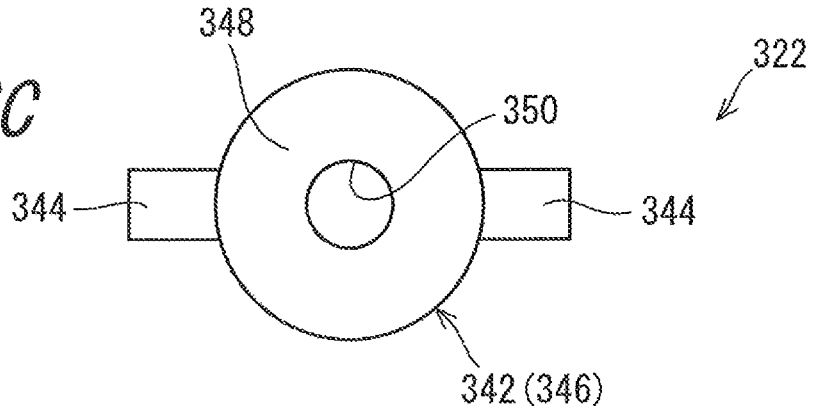
FIG. 16C is a bottom view of the inner portion.
Figure 16D:
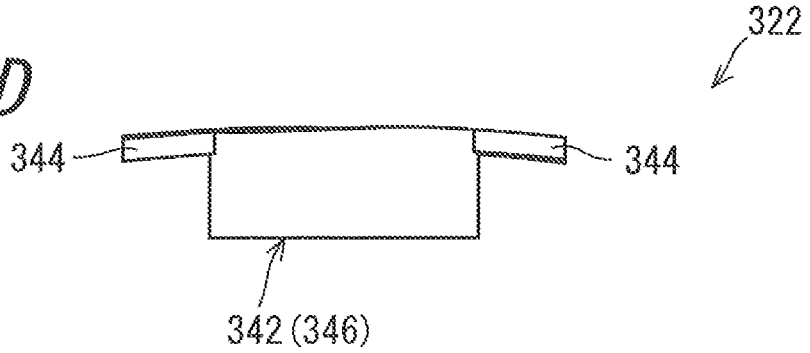
FIG. 16D is a side view of the inner portion.

FIG. 16A is a perspective view of the inner portion 322. FIG. 16B is a plan view of the inner portion 322. FIG. 16C is a bottom view of the inner portion 322. FIG. 16D is a side view of the inner portion 322.

The inner portion 322 includes a base part 342 and an outward extending part 344. The base part 342 includes a cylindrical part 346, a bottom part 348 and a screw hole 350. The outward extending part 344 extends outward from the outer edge part (cylindrical part 346) of the base part 342. A plurality of (two) outward extending parts 344 are provided at separate positions in the circumferential direction of the base part 342. The screw hole 350 constitutes a female screw. The screw hole 350 is screw-connected with the screw part 128.

The inner portion 322 includes an inner surface abutment part 352. When the adjustment member 320 is in the fixed state, the inner surface abutment part 352 abuts against the head inner surface. In the present embodiment, (the upper end surface of) the cylindrical part 346 and the outward extending parts 344 constitute the inner surface abutment part 352.

The inner portion 322 includes an inward protrusion 364. The inward protrusion 364 protrudes from the inner circumferential surface of the cylindrical part 346 toward inside in the radial direction of the cylindrical part 346. The protruding height of the inward protrusion 364 corresponds to the protruding height of the larger-diameter parts 362 of the boss part 334 in the outer portion 324. Two inward protrusions 364 are provided. The inward protrusions 364 are arranged at equal intervals in the circumferential direction. Except for the presence of the inward protrusions 364, the inner portion 322 is the same as the inner portion 122 of the first embodiment.

Figure 17:
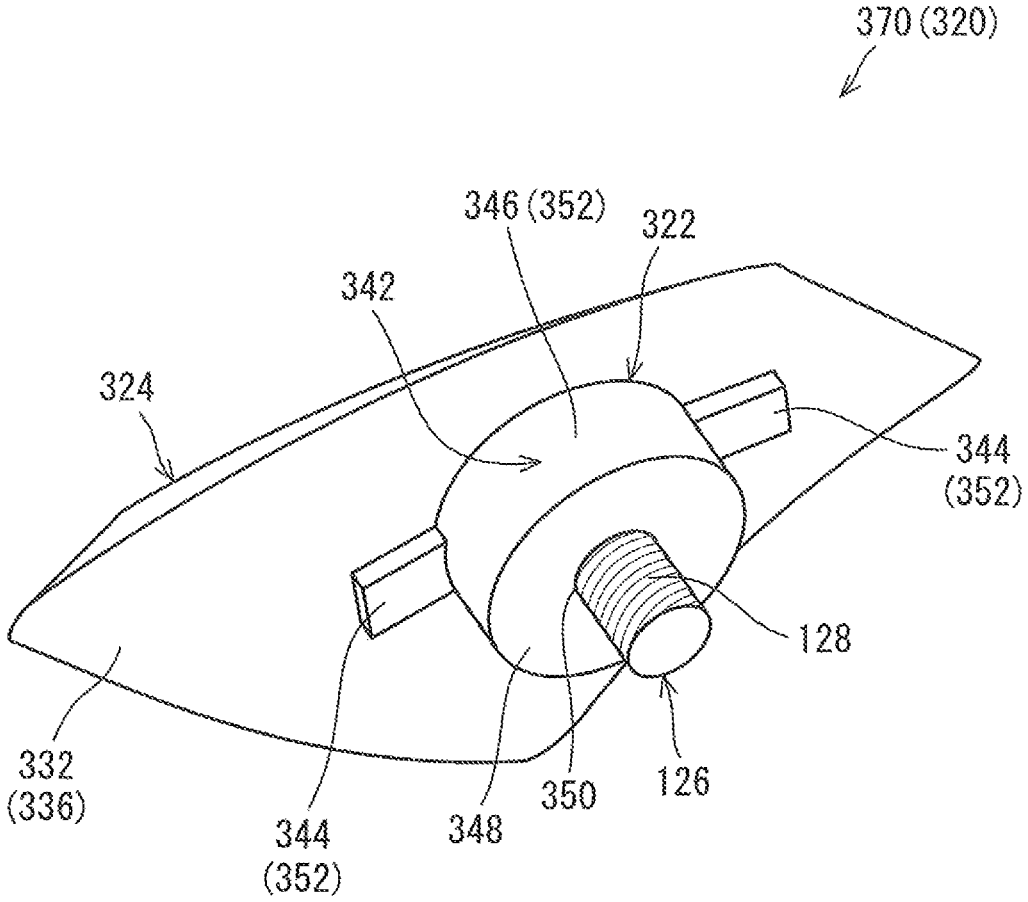
FIG. 17 is a perspective view of an assembly in which the adjustment member of the third embodiment is assembled.

FIG. 17 is a perspective view of an assembly 370 in which all components constituting the adjustment member 320 are assembled. The adjustment member 320 is attached to the head body 302 in the state of the assembly 370. The difference between the adjustment member 320 and the adjustment member 120 is the shape of the boss part of the outer portion, and the presence or absence of the inward protrusions of the inner portion. Accordingly, the appearance of the assembly 370 is the same as the appearance of the assembly 160 (FIG. 6) of the first embodiment. The adjustment member 320 can be retrofitted to the head body 302. The adjustment member 320 can be attached to the head body 302 from the outside of the head body 302. The adjustment member 320 can be detached from the outside of the head body 302.

Figure 18:
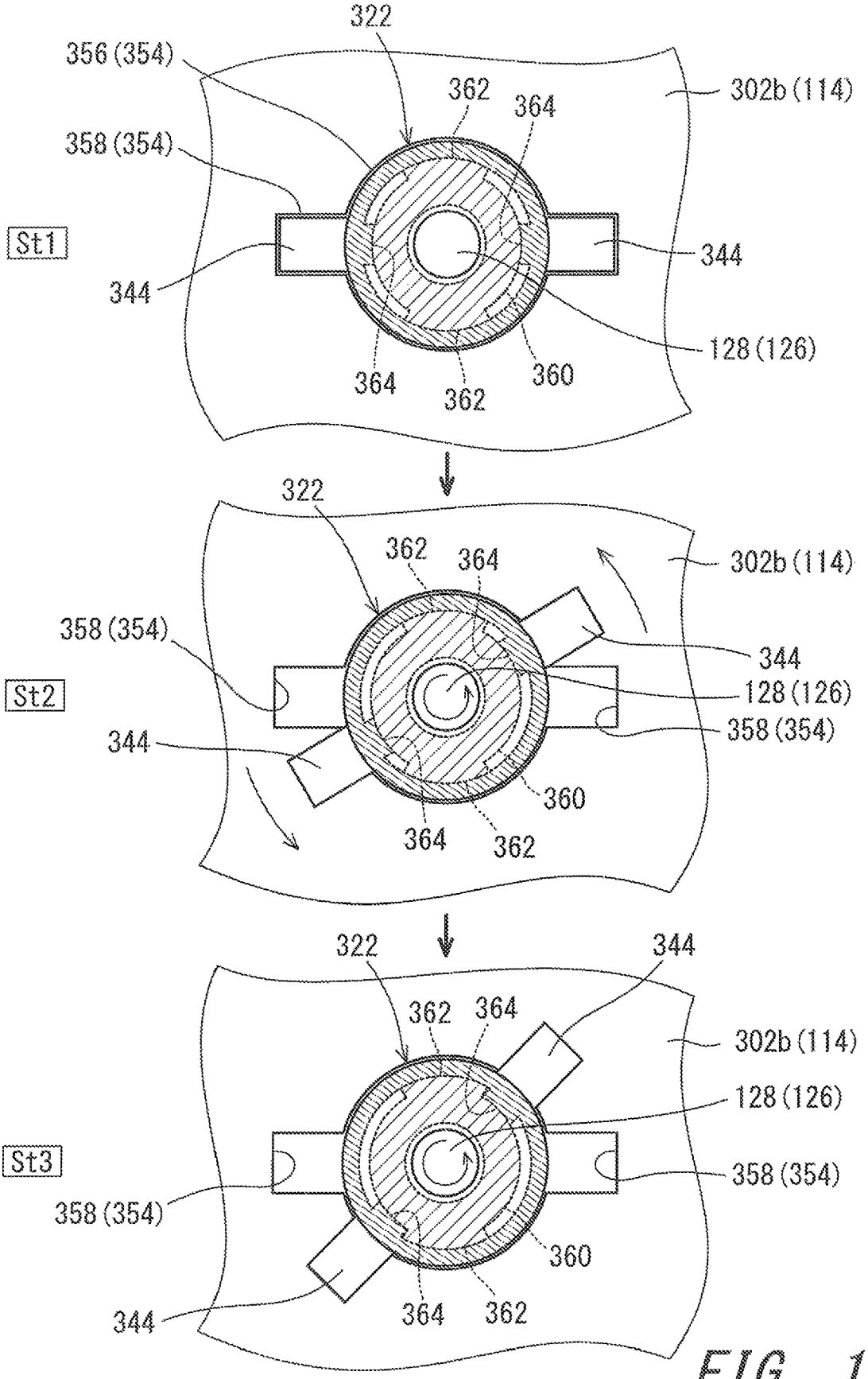
FIG. 18 is a diagram, as viewed from the inside of the head, showing the process of inserting and fixing the adjustment member of the third embodiment to the head body, and for the sake of easy understanding, two members positioned inside the inner portion are indicated by different hatchings.

FIG. 18 is a diagram for illustrating a method of attaching the adjustment member 320. As with FIG. 7 and FIG. 12, FIG. 18 shows a part of the head 300 (head body 302) as viewed from its inside.

Note that, in FIG. 18, parts hidden by the bottom part 348 of the inner portion 322 are shown with dashed lines. The dashed lines show the inward protrusions 364 of the inner portion 322 and the boss part 334. Since the movement of the components is difficult to understand only by the dashed lines, the inner portion 322 and the boss part 334 are shown also using respective hatchings.

The head body 302 includes a head inner surface 302*b*. Unlike the first embodiment (FIG. 7), the head body 302 does not include a body protrusion 164. Unlike the second embodiment (FIG. 10B), the outer portion 324 does not include a penetrating protrusion 241.

For attaching the adjustment member 320, the assembly 370 (FIG. 17) is first prepared. In this assembly 370, a gap should be left between the inner surface abutment part 352 of the inner portion 322 and the outer surface abutment part 336 of the outer portion 324 so as to sandwich the body wall 114 of the head body 302 between the inner surface abutment part 352 and the outer surface abutment part 336.

Next, the inner portion 322 of the assembly 370 is inserted into the opening 354 (FIG. 14) (step St1). This inserting step is conducted while mating the angular position of the inner portion 322 in its rotational direction with the angular position of the opening 354 in its circumferential direction. That is, the rotational position of the inner portion 322 is adjusted to the pass-through position. The upper-most drawing in FIG. 18 shows a state in which the inner portion 322 has passed through the opening 354 as viewed from the inside of the head 300. At this time, the inner portion 322 is positioned inside the head body 302.

Next, the rotary connecting portion 126 is rotated in the tightening direction (step St2). At this time, the inner portion 322 corotates together with the rotary connecting portion 126. As these portions further corotate together, the inward protrusions 364 of the inner portion 322 move closer to the respective larger-diameter parts 362 of the boss part 334. This corotation changes the rotational position of the inner portion 322 to the non-pass-through position.

Next, the inward protrusions 364 abut against the respective larger-diameter parts 362 (step St3). This abutment prevents further corotation of the inner portion 322 with the rotary connecting portion 126. The rotary connecting portion 126 is further rotated in the tightening direction in the state where the corotation is prevented. In this rotation, the rotary connecting portion 126 is rotated without rotation of the inner portion 322, and thus the screw is tightened. As a result, the rotary connecting portion 126 is completely tightened to attain the fixed state.

For detaching the adjustment member 320, the rotary connecting portion 126 is rotated in the reverse direction to the tightening direction. The inner portion 322 can corotate together with the rotary connecting portion 126. Further rotation of the rotary connecting portion 126, however, causes the inward protrusions 364 to abut against the respective larger-diameter parts 362 whereby further corotation is prevented. Accordingly, the rotary connecting portion 126 can be loosened. After loosening the rotary connecting portion 126, the rotational position of the inner portion 322 is adjusted to the pass-through position, and then the inner portion 322 is passed through the opening 354 to detach the assembly 370 (adjustment member 320) from the head body 302. In the present embodiment, the combination between the inner portion 322 and the outer portion 324 constitutes a rotation blocking part that blocks relative rotation between the inner portion 322 and the outer portion 324 at a predetermined rotational position. In the present embodiment, the rotation blocking part is a corotation prevention portion.

Figure 19A:
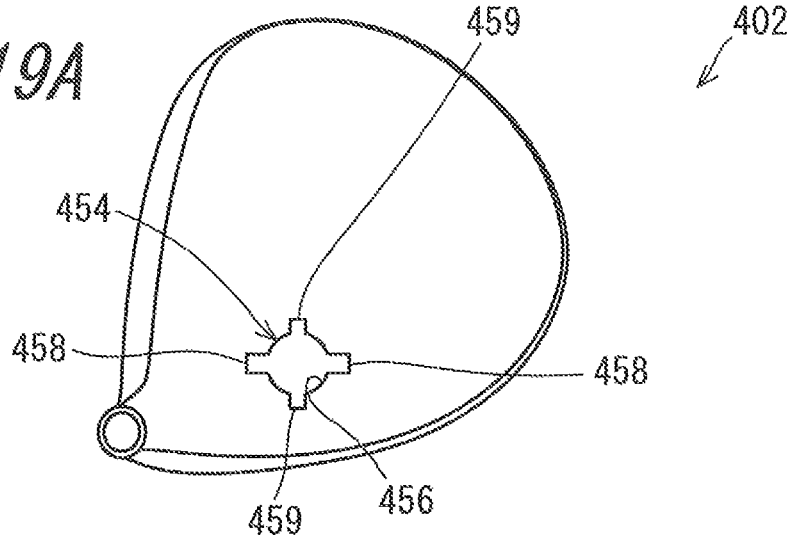
FIG. 19A is a perspective view of a head body according to a fourth embodiment.
Figure 19B:
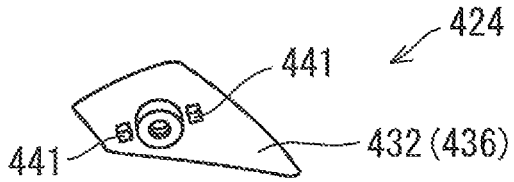
FIG. 19B is a perspective view of an outer portion of an adjustment member according to the fourth embodiment.
Figure 19C:
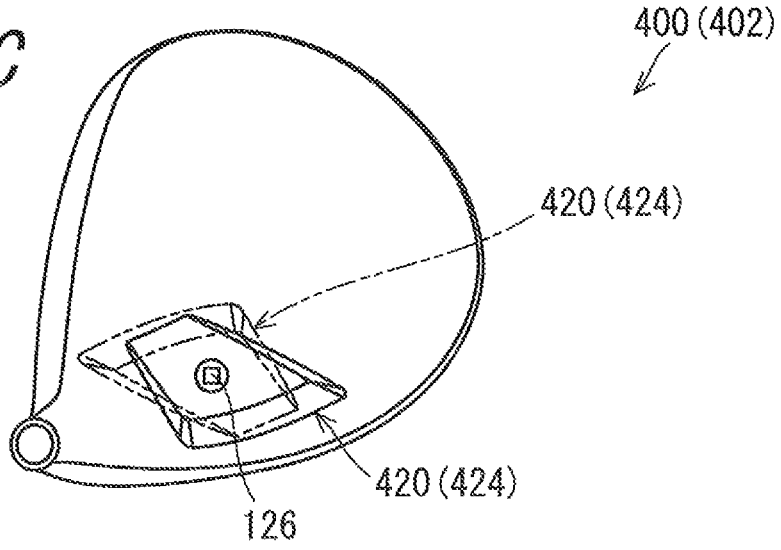
FIG. 19C is a perspective view of a head according to the fourth embodiment.

FIG. 19A is a perspective view of a head body 402 according to a fourth embodiment. FIG. 19B is a perspective view of an outer portion 424 of an adjustment member 420 according to the fourth embodiment. FIG. 19C is a perspective view of a head 400 according to the fourth embodiment. The head 400 includes the head body 402 and the adjustment member 420. The adjustment member 420 includes the outer portion 424, an inner portion, and a rotary connecting portion 126. The inner portion is not shown in FIG. 19A to FIG. 19C, but has the same configuration as the inner portion 122 of the first embodiment (FIG. 5A to FIG. 5D).

The outer portion 424 includes a penetrating protrusion 441 on its bottom surface 432 (outer surface abutment part 436). Two penetrating protrusions 441 are provided. Although the number of the penetrating protrusion 241 is one in the second embodiment (FIG. 10B), two penetrating protrusions 441 are provided in the present embodiment. Except for this point, the outer portion 424 has the same configuration as the outer portion 224 of the second embodiment.

An opening 454 is formed in the head body 402. The opening 454 includes a circular part 456, outward extending parts 458 that extend outward from the circular part 456, and a supplementary opening 459. A shape that is formed by the circular part 456 and the outward extending parts 458 corresponds to the shape of the inner portion in the planar view. The supplementary opening 459 is continuous with the circular part 456. The supplementary opening 459 is formed at a position different from the positions of the outward extending parts 458. Two supplementary openings 459 are formed. The penetrating protrusions 441 penetrate through the respective supplementary openings 459. As with the second embodiment, the penetrating protrusions 441 protrude from the head inner surface toward the inside of the head 400. The penetrating protrusions 441 function as corotation prevention protrusions (corotation prevention portions).

There are two rotational positions of the outer portion 424 at which the two penetrating protrusions 441 can be inserted to the two supplementary openings 459. These two rotational positions are referred to as a first rotational position and a second rotational position. The difference in angular position in the rotational direction of the outer portion 424 between the first rotational position and the second rotational position is 180°. The outer portion 424 situated at the first rotational position is indicated by solid line in FIG. 19C. The outer portion 424 situated at the second rotational position is indicated by two-dot chain line in FIG. 19C. The rotational position of the outer portion 424 changes aerodynamic properties of the head 400, for example. The rotational position of the outer portion 424 changes the position of the center of gravity of the head 400, for example. The orientation (rotational position) of the outer portion 424 can be adjusted in the head 400.

Figure 20A:
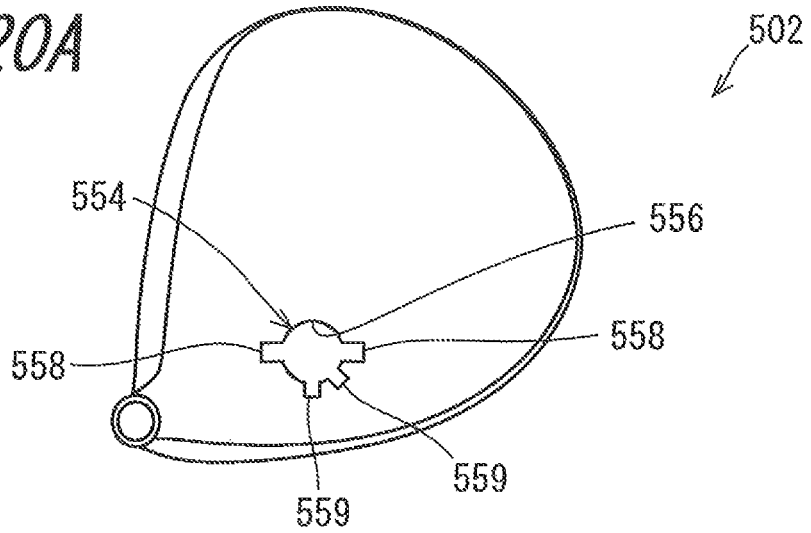
FIG. 20A is a perspective view of a head body according to a fifth embodiment.
Figure 20B:
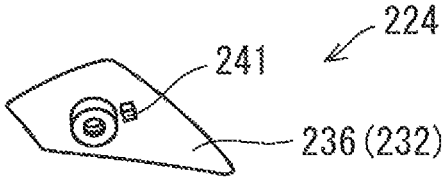
FIG. 20B is a perspective view of an outer portion of an adjustment member according to the fifth embodiment.
Figure 20C:
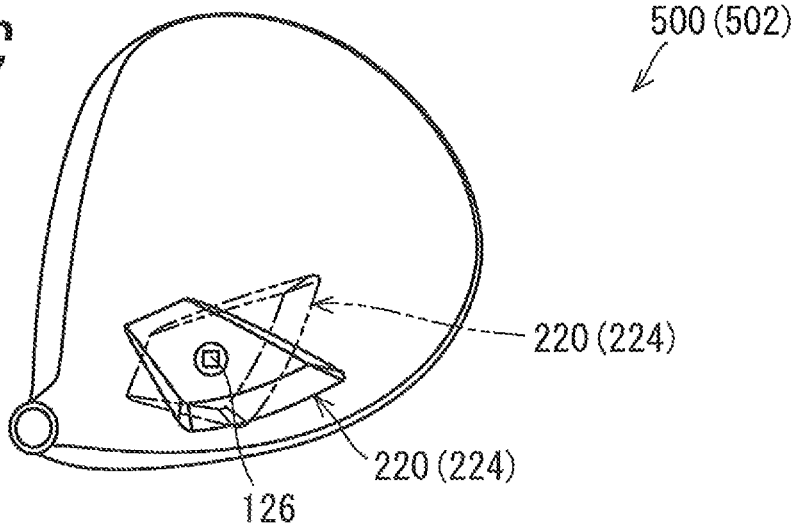
FIG. 20C is a perspective view of a head according to the fifth embodiment.

FIG. 20A is a perspective view of a head body 502 according to a fifth embodiment. FIG. 20B is a perspective view of an outer portion 224 of an adjustment member 220 according to the fifth embodiment. FIG. 20C is a perspective view of a head 500 according to the fifth embodiment. The head 500 includes the head body 502 and the adjustment member 220. The adjustment member 220 includes the outer portion 224, an inner portion, and a rotary connecting portion 126. The adjustment member 220 has the same configuration as the adjustment member 220 of the second embodiment. The inner portion is not shown in FIG. 20A to FIG. 20C, but has the same configuration as the inner portion 122 of the first embodiment (FIG. 5A to FIG. 5D).

The outer portion 224 has the same configuration as the outer portion 224 of the second embodiment. The outer portion 224 includes a penetrating protrusion 241 on its bottom surface 232 (outer surface abutment part 236). The number of the penetrating protrusion 241 is one.

An opening 554 is formed in the head body 502. The opening 554 includes a circular part 556, outward extending parts 558 that extend outward from the circular part 556, and a supplementary opening 559. A shape that is formed by the circular part 556 and the outward extending parts 558 corresponds to the shape of the inner portion in the planar view. Two supplementary openings 559 are formed at different positions. Each supplementary opening 559 is continuous with the circular part 556. The supplementary openings 559 are formed at positions different from the positions of the outward extending parts 558. The penetrating protrusion 241 penetrates through one of the supplementary openings 559. As with the second embodiment, the penetrating protrusion 241 protrudes from the head inner surface toward the inside of the head 500. The penetrating protrusion 241 functions as the corotation prevention protrusion (corotation prevention portion).

The penetrating protrusion 241 can be inserted to either one of the two supplementary openings 559. The rotational position of the outer portion 224 changes depending on which one of the supplementary openings 559 is selected. Accordingly, the outer portion 224 can be fixed at two rotational positions. The difference in angular position in the rotational direction of the outer portion 224 between a first rotational position and a second rotational position is 45°. The outer portion 224 situated at the first rotational position is indicated by solid line in FIG. 20C. The outer portion 224 situated at the second rotational position is indicated by two-dot chain line in FIG. 20C. The rotational position of the outer portion 224 changes aerodynamic properties of the head 500, for example. The rotational position of the outer portion 224 changes the position of the center of gravity of the head 500, for example. The orientation (rotational position) of the outer portion 224 can be adjusted in the head 500.

Figure 21A:
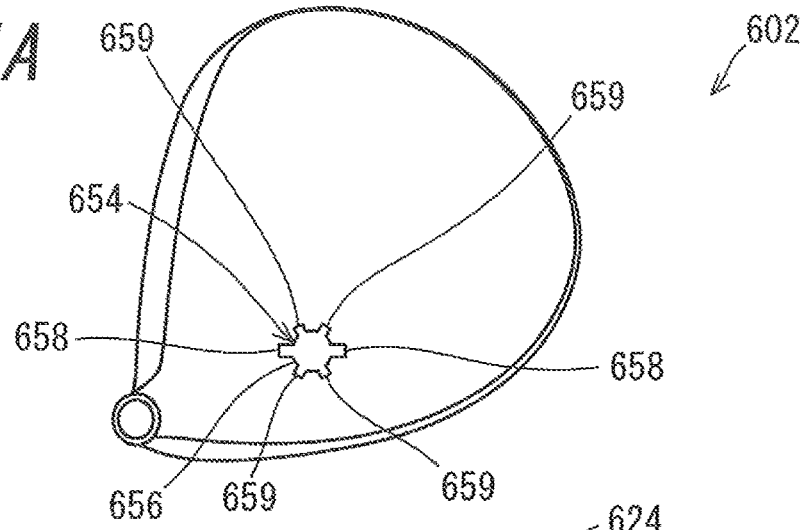
FIG. 21A is a perspective view of a head body according to a sixth embodiment.
Figure 21B:
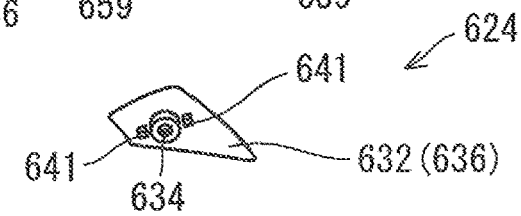
FIG. 21B is a perspective view of an outer portion of an adjustment member according to the sixth embodiment.
Figure 21C:
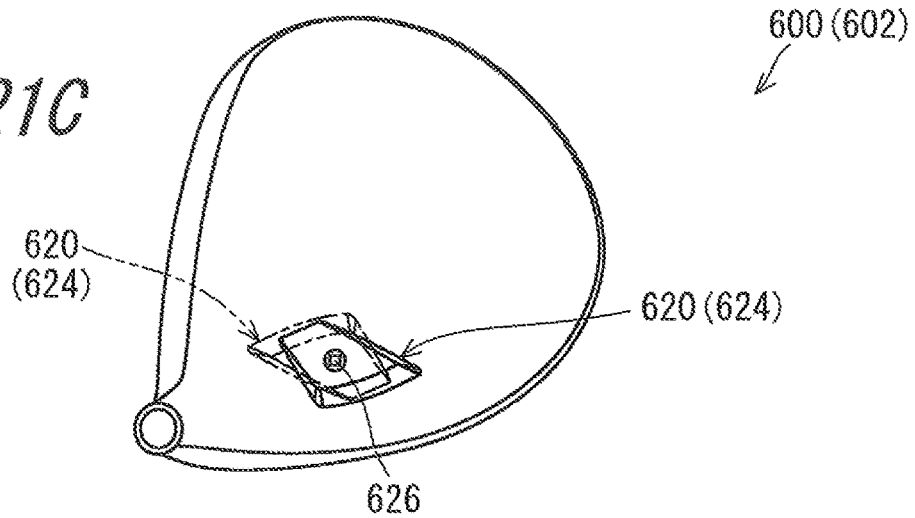
FIG. 21C and FIG. 21D are perspective views of a head according to the sixth embodiment.
Figure 21D:
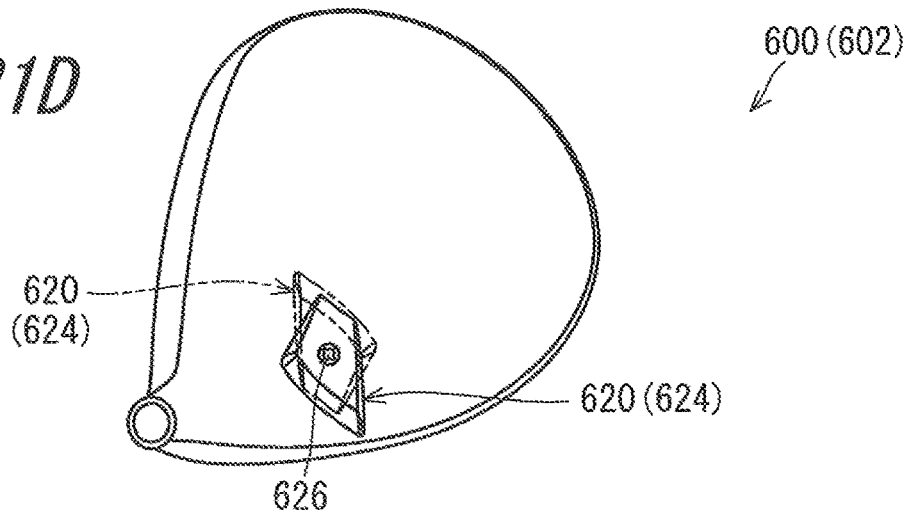

FIG. 21A is a perspective view of a head body 602 according to a sixth embodiment. FIG. 21B is a perspective view of an outer portion 624 of an adjustment member 620 according to the sixth embodiment. FIG. 21C and FIG. 21D are perspective views of a head 600 according to the sixth embodiment. The head 600 includes the head body 602 and the adjustment member 620. The adjustment member 620 includes the outer portion 624, an inner portion (not shown in the drawings), and a rotary connecting portion 626. The adjustment member 620 has the same configuration as the adjustment member 420 of the fourth embodiment except that the overall size is reduced as compared to the adjustment member 420. The inner portion is not shown in FIG. 21A to FIG. 21D, but has the same shape as the inner portion 122 of the first embodiment and has a reduced size as a whole as compared to the inner portion 122. The rotary connecting portion 626 is also structured such that the size of the rotary connecting portion 626 corresponds to the size of them.

The outer portion 624 has the same configuration as the outer portion 424 of the fourth embodiment except that the overall size is reduced as compared to the outer portion 424. The outer portion 624 includes a boss part 634 and a penetrating protrusion 641 on its bottom surface 632 (outer surface abutment part 636). Two penetrating protrusions 641 are provided. The two penetrating protrusions 641 are arranged on a straight line that intersects the center line of the boss part 634 and is perpendicular to the center line.

An opening 654 is formed in the head body 602. The opening 654 includes a circular part 656, outward extending parts 658 that extend outward from the circular part 656, and a supplementary opening 659. A shape that is formed by the circular part 656 and the outward extending parts 658 corresponds to the shape of the inner portion in the planar view. Four supplementary openings 659 are formed at different positions. Two supplementary openings 659 are formed on a straight line, and the remaining two supplementary openings 659 are formed on another straight line. Each supplementary opening 659 is continuous with the circular part 656. The supplementary openings 659 are formed at positions different from the positions of the outward extending parts 658. The two penetrating protrusions 641 penetrate through two of the four supplementary openings 659. As with the second embodiment, the penetrating protrusions 641 protrude from the head inner surface toward the inside of the head 600. The penetrating protrusions 641 function as corotation prevention protrusions (corotation prevention portions).

There are four rotational positions of the outer portion 624 at which the two penetrating protrusions 641 can be inserted to two of the four supplementary openings 659. That is, the outer portion 624 can be fixed at four rotational positions, which are first to fourth rotational positions. The difference in angular position in the rotational direction of the outer portion 624 between the first rotational position and the second rotational position is 180°. The outer portion 624 situated at the first rotational position is indicated by solid line in FIG. 21C. The outer portion 624 situated at the second rotational position is indicated by two-dot chain line in FIG. 21C. The difference in angular position in the rotational direction of the outer portion 624 between the third rotational position and the fourth rotational position is 180°. The outer portion 624 situated at the third rotational position is indicated by solid line in FIG. 21D. The outer portion 624 situated at the fourth rotational position is indicated by two-dot chain line in FIG. 21D. The difference in angular position in the rotational direction of the outer portion 624 between the first rotational position and the third rotational position is 60°. The rotational position of the outer portion 624 changes aerodynamic properties of the head 600, for example. The rotational position of the outer portion 624 changes the position of the center of gravity of the head 600, for example. The orientation (rotational position) of the outer portion 624 can be adjusted in the head 600.

Figure 22A:
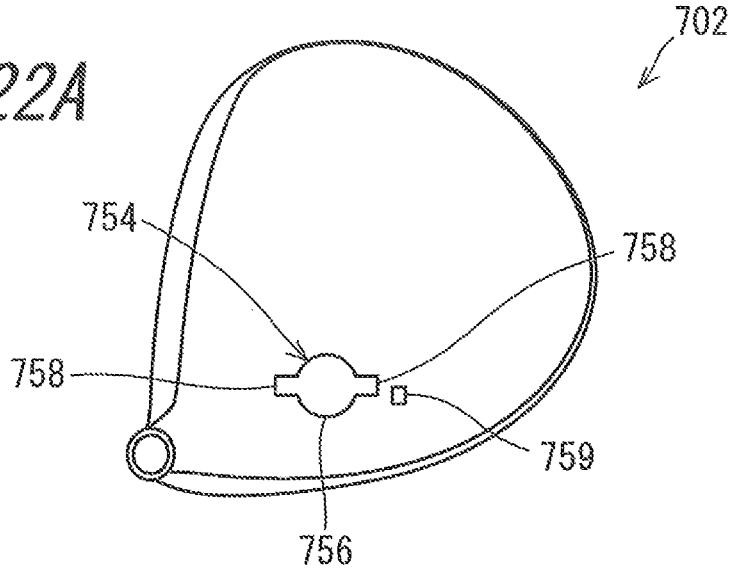
FIG. 22A is a perspective view of a head body according to a seventh embodiment.
Figure 22B:
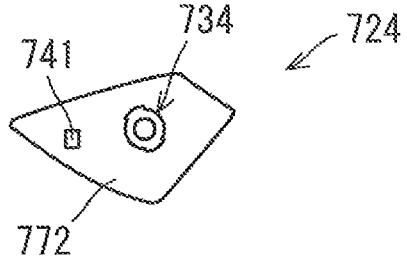
FIG. 22B is a bottom view of an outer portion of an adjustment member according to the seventh embodiment.
Figure 22C:
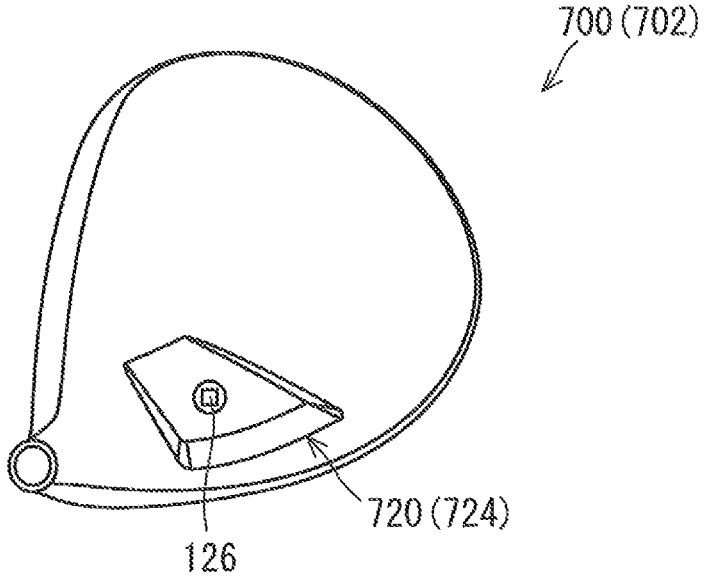
FIG. 22C is a perspective view of a head according to the seventh embodiment.

FIG. 22A is a perspective view of a head body 702 according to a seventh embodiment. FIG. 22B is a bottom view of an outer portion 724 of an adjustment member 720 according to the seventh embodiment. FIG. 22C is a perspective view of a head 700 according to the seventh embodiment. The head 700 includes the head body 702 and the adjustment member 720. The adjustment member 720 includes the outer portion 724, an inner portion (not shown in the drawings), and a rotary connecting portion 126. The adjustment member 720 has the same configuration as the adjustment member 320 of the third embodiment except that the outer portion 724 includes an outer engaging part 741. The inner portion is not shown in FIG. 22A to FIG. 22C, but has the same configuration as the inner portion 322 of the third embodiment (FIG. 16A to FIG. 16D).

The outer portion 724 has the same configuration as the outer portion 324 of the third embodiment (FIG. 15A to FIG. 15C) except that the outer portion 724 includes the outer engaging part 741. The outer portion 724 includes a boss part 734 and the outer engaging part 741. The outer engaging part 741 is a protrusion that protrudes from a bottom surface 772 of the outer portion 724. As with the third embodiment (FIG. 18), a corotation prevention portion is constituted by the combination between the outer portion 724 and the inner portion in the present embodiment. Note that the outer engaging part 741 may be a recess.

An opening 754 is formed in the head body 702. The opening 754 includes a circular part 756 and outward extending parts 758 that extend outward from the circular part 756. Further, a body engaging part 759 is formed in the head body 702. The body engaging part 759 is a through hole. The body engaging part 759 is provided at a position spaced apart from the opening 754. The outer engaging part 741 is inserted into the body engaging part 759. The outer engaging part 741 which is a protrusion penetrates through the body engaging part 759. The outer engaging part 741 is located at a position at which the inner portion cannot abut against the outer engaging part 741. The outer engaging part 741 is not a corotation prevention portion. In the present embodiment, the corotation prevention portion is formed by the combination between the outer portion 724 and the inner portion, and thus the outer engaging part 741 does not need to be a corotation prevention portion. The engagement between the body engaging part 759 and the outer engaging part 741 determines the orientation (rotational position) of the outer portion 724. The engagement between the body engaging part 759 and the outer engaging part 741 prevents the outer portion 724 from corotating with the rotary connecting portion 126 when the rotary connecting portion 126 is rotated. Note that the body engaging part 759 may be a recess that does not penetrate thorough the body wall, or may be a protrusion. The body engaging part 759 should have a shape that can engage with the outer engaging part 741. When the outer engaging part 741 is a recess, the body engaging part 759 can be a protrusion.

Figure 23A:
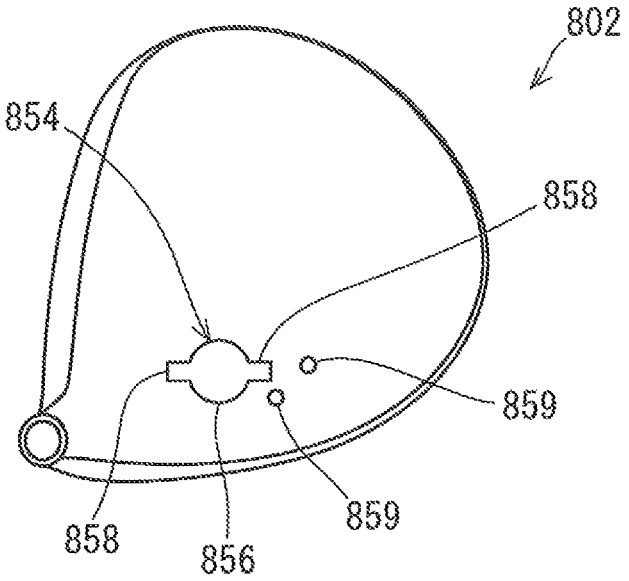
FIG. 23A is a perspective view of a head body according to an eighth embodiment.
Figure 23B:
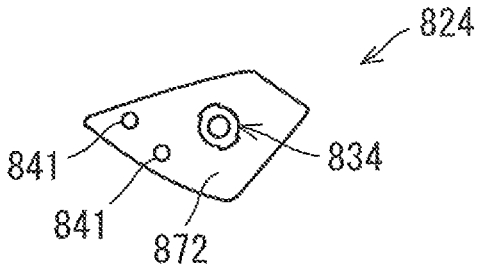
FIG. 23B is a bottom view of an outer portion of an adjustment member according to the eighth embodiment.
Figure 23C:
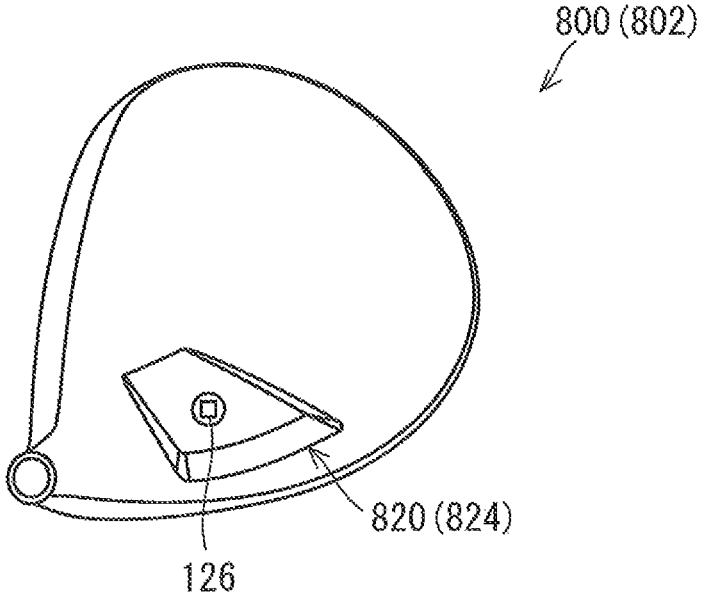
FIG. 23C is a perspective view of a head according to the eighth embodiment.

FIG. 23A is a perspective view of a head body 802 according to an eighth embodiment. FIG. 23B is a bottom view of an outer portion 824 of an adjustment member 820 according to the eighth embodiment. FIG. 23C is a perspective view of a head 800 according to the eighth embodiment. The head 800 includes the head body 802 and the adjustment member 820. The adjustment member 820 includes the outer portion 824, an inner portion (not shown in the drawings), and a rotary connecting portion 126. The adjustment member 820 has the same configuration as the adjustment member 320 of the third embodiment except that the outer portion 824 includes an outer engaging part 841. The inner portion is not shown in FIG. 23A to FIG. 23C, but has the same configuration as the inner portion 322 of the third embodiment (FIG. 16A to FIG. 16D).

The outer portion 824 has the same configuration as the outer portion 324 of the third embodiment (FIG. 15A to FIG. 15C) except that the outer portion 824 includes the outer engaging part 841. The outer portion 824 includes a boss part 834 and the outer engaging part 841. Two outer engaging parts 841 are provided. The outer engaging parts 841 are protrusions that protrude from a bottom surface 872 of the outer portion 824. As with the third embodiment (FIG. 18), a corotation prevention portion is constituted by the combination between the outer portion 824 and the inner portion in the present embodiment. Note that the outer engaging parts 841 may be recesses.

An opening 854 is formed in the head body 802. The opening 854 includes a circular part 856 and outward extending parts 858 that extend outward from the circular part 856. The head body 802 further includes a body engaging part 859. Two body engaging parts 859 are provided so as to correspond to the two outer engaging parts 841. The body engaging parts 859 are provided at positions spaced apart from the opening 854. The body engaging parts 859 are recesses that do not penetrate through the body wall. The outer engaging parts 841 are inserted into the respective body engaging parts 859. The outer engaging parts 841 are located at positions at which the inner portion cannot abut against the outer engaging parts 841. The outer engaging parts 841 are not corotation prevention portions. In the present embodiment, the corotation prevention portion is formed by the combination between the outer portion 824 and the inner portion, and thus the outer engaging parts 841 do not need to be corotation prevention portions. The engagement between the body engaging parts 859 and the outer engaging parts 841 determines the orientation (rotational position) of the outer portion 824. The two body engaging parts 859 and the two outer engaging parts 841 further accurately determine the rotational position of the outer portion 824. The engagement between the body engaging parts 859 and the outer engaging parts 841 prevents the outer portion 824 from corotating with the rotary connecting portion 126 when the rotary connecting portion 126 is rotated. Note that the body engaging parts 859 may be through holes, or may be protrusions. The body engaging parts 859 each should have a shape that can engage with the respective outer engaging parts 841. When the outer engaging parts 841 are recesses, the body engaging parts 859 can be protrusions.

Figure 24A:
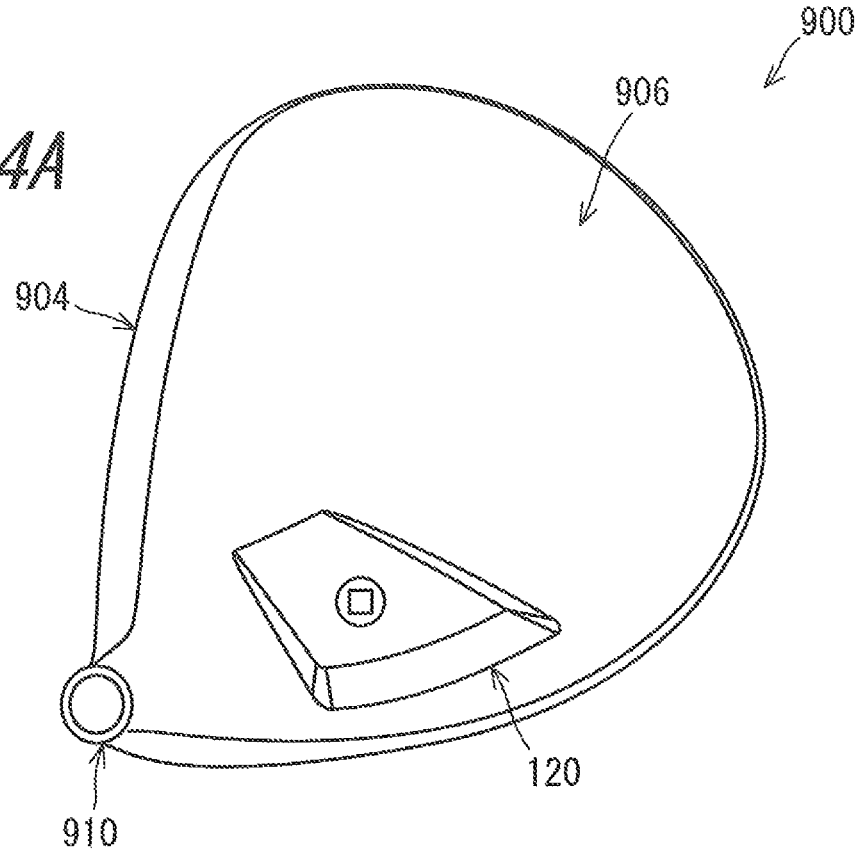
FIG. 24A is a perspective view of a head according to a ninth embodiment as viewed from its crown side.
Figure 24B:
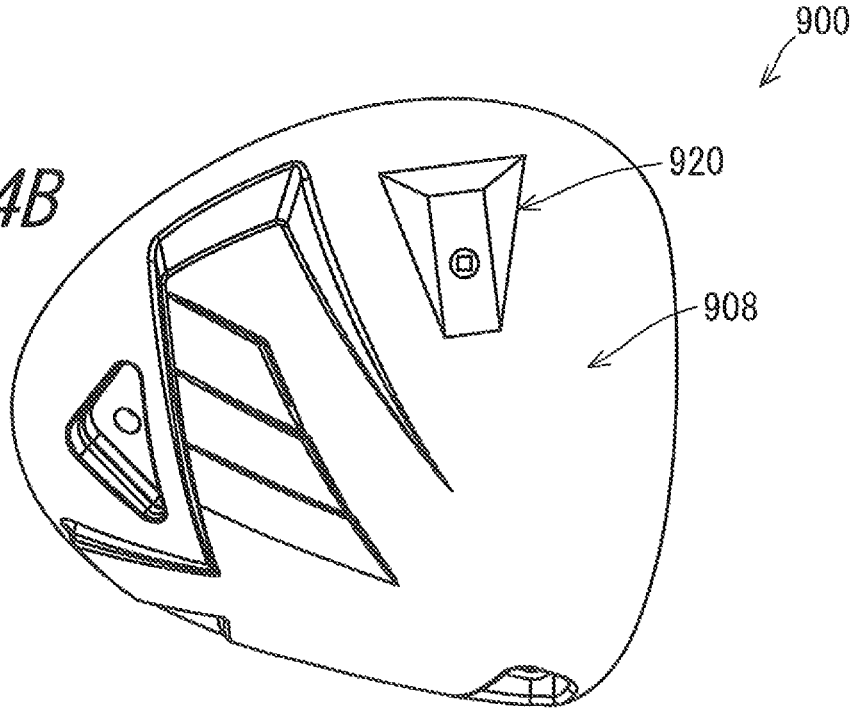
FIG. 24B is a perspective view of the head as viewed from its sole side.

FIG. 24A is a perspective view of a head 900 according to a ninth embodiment as viewed from its crown side. FIG. 24B is a perspective view of the head 900 as viewed from its sole side. The head 900 includes a face portion 904, a crown portion 906, a sole portion 908, and a hosel portion 910. The head 900 includes an adjustment member 120 and an adjustment member 920. The adjustment member 120 is disposed on the crown portion 906. The adjustment member 120 is located on the heel side with respect to the face center. The adjustment member 920 is disposed on the sole portion 908. The adjustment member 920 is located on the toe side with respect to the face center. A plurality of adjustment members may be provided as in the present embodiment. The number of the adjustment members is not limited. The position of each adjustment member is not limited. The position and number of the adjustment member(s) can be appropriately set in accordance with the purpose of the adjustment member(s).

Figure 25A:
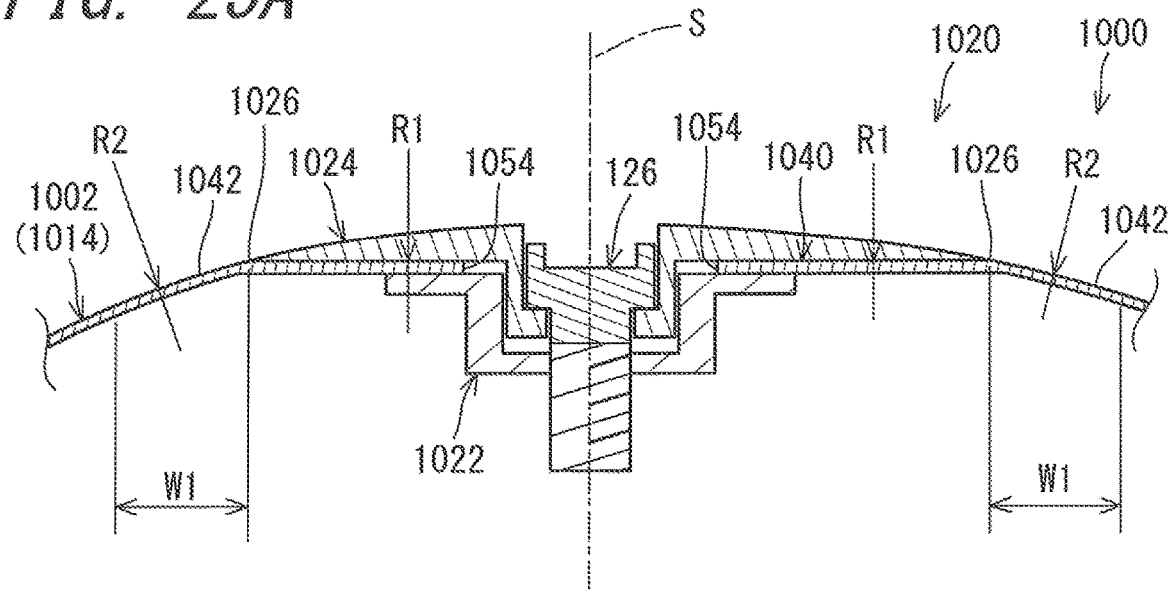
FIG. 25A is a cross-sectional view of an adjustment member and its vicinity of a head according to tenth embodiment.

FIG. 25A is a cross-sectional view of an adjustment member and its vicinity of a head 1000 according to a tenth embodiment. FIG. 25A is a cross-sectional view showing the fixed state. A body wall 1014 of a head body 1002 of the head 1000 has an opening 1054. The adjustment member 1020 is fixed to the opening 1054. The adjustment member 1020 includes an inner portion 1022, an outer portion 1024, and a rotary connecting portion 126. The body wall 1014 is sandwiched between the inner portion 1022 and the outer portion 1024.

Figure 25B:
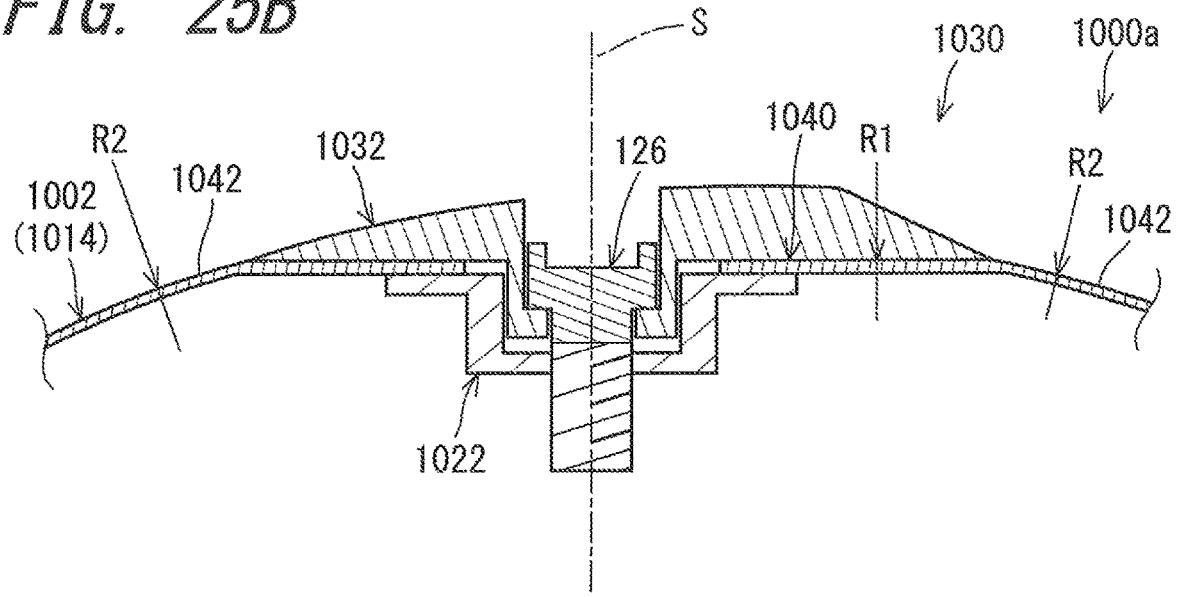
FIG. 25B is a cross-sectional view of an adjustment member and its vicinity of a head according to a modification example of the tenth embodiment.

FIG. 25B is a cross-sectional view of an adjustment member and its vicinity of a head 1000*a* according to a modification example of the tenth embodiment. The adjustment member 1030 of the head 1000*a* includes an outer portion 1032 instead of the outer portion 1024. The outer portion 1032 has an outer shape different from that of the outer portion 1024. The head 1000*a* has the same configuration as the head 1000 except for the difference in the outer portion.

The difference between the head 1000 and the head 100 of the first embodiment is that the head body 1002 includes a flatter portion 1040 the head outer surface of which has a curvature radius greater than that of the head outer surface of a surrounding portion 1042 situated around the flatter portion 1040. Each of the adjustment member 1020 and the adjustment member 1030 is fixed to the flatter portion 1040. The head body 1002 includes the surrounding portion 1042 around the flatter portion 1040. The surrounding portion 1042 adjoins the flatter portion 1040. In the surrounding portion 1042, the outer surface of the head body 1002 is a convex curved surface. The surrounding portion 1042 is disposed in the crown portion.

A reference symbol R1 in FIG. 25A and FIG. 25B shows the curvature radius of the outer surface of the head body 1002 in the flatter portion 1040. A reference symbol R2 in FIG. 25A and FIG. 25B shows the curvature radius of the outer surface of the head body 1002 in the surrounding portion 1042. The curvature radius R1 is greater than the curvature radius R2. The curvature radius R1 and the curvature radius R2 are measured in a cross section that contains the center line S of the rotary connecting portion 126. In all cross sections that contain the center line S, the curvature radius R1 is greater than the curvature radius R2. As in the present embodiment, the curvature radius R1 may be infinite. That is, in the flatter portion 1040, the head outer surface may be a flat surface. The surrounding portion 1042 surrounds the entire perimeter of the flatter portion 1040.

The presence of the flatter portion 1040 can reduce a substantial protruding height of the adjustment member from the head outer surface. In the embodiment of FIG. 25A, the curvature radius of the outer surface of the outer portion 1024 is substantially equal to the curvature radius R2 of the surrounding portion 1042. This means that the adjustment member does not substantially protrude from the head outer surface. In addition, an outer edge 1026 of the outer portion 1024 coincides with the outer edge of the flatter portion 1040. The outer surface of the outer portion 1024 is continuous with the outer surface of the surrounding portion 1042. Also in the embodiment of FIG. 25B, the presence of the flatter portion 1040 lessens the protruding height of the adjustment member 1030.

Double-pointed arrows W1 in FIG. 25A show a width of the surrounding portion 1042. From the viewpoint of preventing the adjustment member from appearing to protrude, the width W1 is preferably greater than or equal to 5 mm, more preferably greater than or equal to 7 mm, and still more preferably greater than or equal to 10 mm. Considering dimensions of a head, the width W1 can be set to be less than or equal to 40 mm, further set to be less than or equal to 30 mm, and even set to be less than or equal to 20 mm. The width W1 is measured in a cross section that contains the center line S of the rotary connecting portion 126. The width W1 is measured in a direction perpendicular to the center line S. The minimum value of the width W1 means the minimum value in widths W1 measured in cross sections that include the center line S. When the outer portion 1024 is disposed in the vicinity of the contour of the crown portion, a width from the outer edge 1026 of the outer portion 1024 to the contour of the crown portion can be defined as the width W1. In this case, in an area in which the outer edge 1026 is located close to the contour of the crown portion, the width W1 can be set to be less than 5 mm, further set to be less than or equal to 3 mm, further set to be less than or equal to be 1 mm, and still further set to be 0 mm. This "0 mm" means that the outer edge 1026 coincides with the contour of the crown portion. In an area in which the outer edge 1026 is located 5 mm or more apart from the contour of the crown portion, the width W1 can be set to be the above-described preferable range (greater than or equal to 5 mm and less than or equal to 40 mm).

Figure 26:
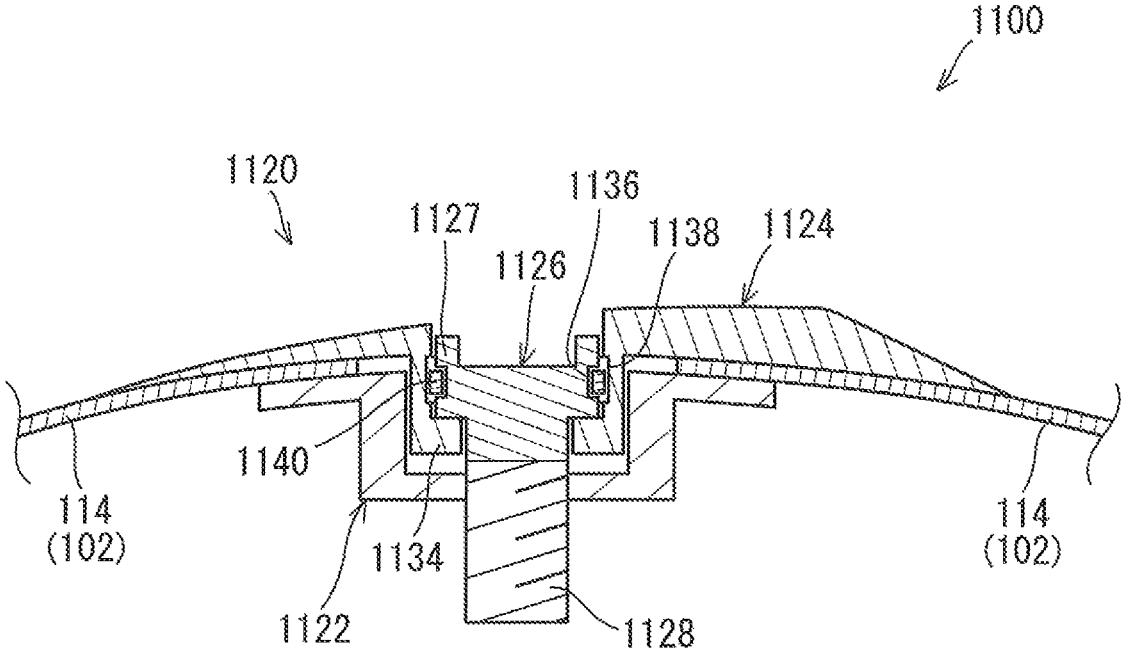
FIG. 26 is a cross-sectional view of an adjustment member and its vicinity of a head according to an eleventh embodiment.

FIG. 26 is a cross-sectional view of an adjustment member and its vicinity of a head 1100 according to an eleventh embodiment. FIG. 26 is a cross-sectional view showing the fixed state. The adjustment member 1120 of the head 1100 includes an inner portion 1122, an outer portion 1124, and a rotary connecting portion 1126. The outer portion 1124 includes a boss part 1134. The rotary connecting portion 1126 includes a head part 1127 and a screw part 1128. The head part 1127 is disposed inside the boss part 1134. The adjustment member 1120 is fixed to a body wall 114 (head body 102). Except for the structures explained below, the adjustment member 1120 has the same configuration as the adjustment member 120, and the head 1100 has the same configuration as the head 100.

The head part 1127 of the rotary connecting portion 1126 has a recess 1136 on its outer circumferential surface. The recess 1136 is a circumferential groove. The boss part 1134 has a recess 1138 on its inner circumferential surface. The recess 1138 is a circumferential groove. When the adjustment member 1120 is in the fixed state, the recess 1136 and the recess 1138 face each other. A ring member 1140 is disposed between the recess 1136 and the recess 1138. A C-shaped washer, for example, can be served as the ring member 1140. The ring member 1140 is fitted on the recess 1136. The ring member 1140 engages with the recess 1136 and the recess 1138, thereby preventing the rotary connecting portion 1126 from falling out of the outer portion 1124. Thus, the present embodiment includes a falling-off prevention portion located between the rotary connecting portion 1126 and the outer portion 1124, the falling-off prevention portion preventing the rotary connecting portion 1126 from falling out of the outer portion 1124 while allowing the rotary connecting portion 1126 to freely rotate with respect to the outer portion 1124.

Figure 27:
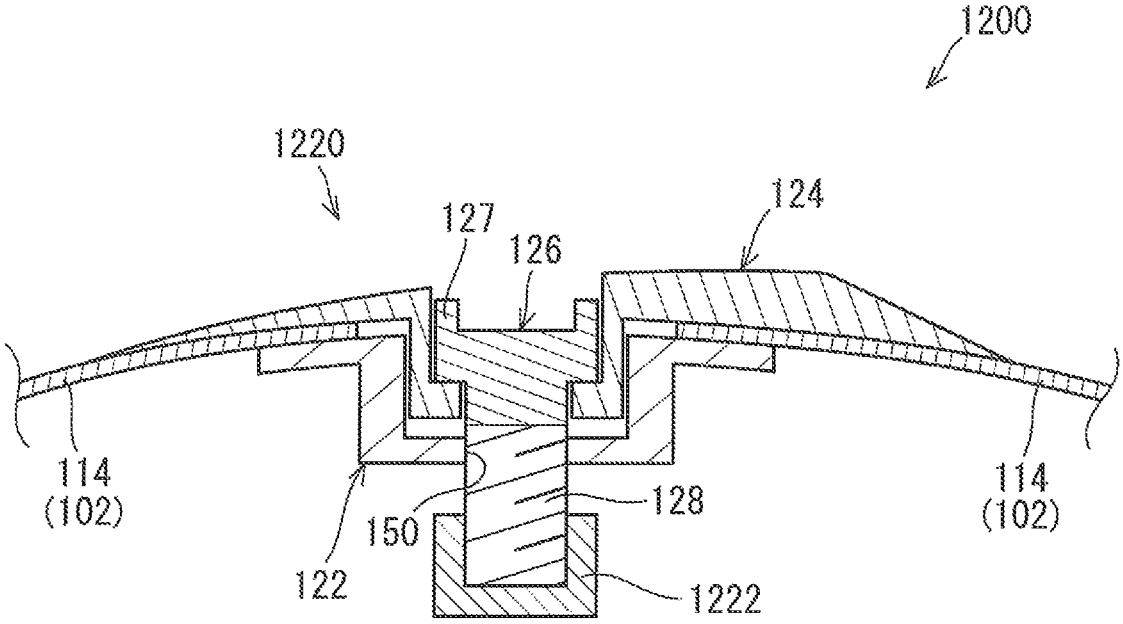
FIG. 27 is a cross-sectional view of an adjustment member and its vicinity of a head according to a twelfth embodiment.

FIG. 27 is a cross-sectional view of an adjustment member and its vicinity of a head 1200 according to a twelfth embodiment. FIG. 27 is a cross-sectional view showing the fixed state. The adjustment member 1220 of the head 1200 includes an inner portion 122, an outer portion 124, and a rotary connecting portion 126. The rotary connecting portion 126 includes a head part 127 and a screw part 128. A cap 1222 is attached to a tip part of the screw part 128. The adjustment member 1220 is fixed to a body wall 114 (head body 102). Except for the presence of the cap 1222, the adjustment member 1220 has the same configuration as the adjustment member 120 of the first embodiment, and the head 1200 has the same configuration as the head 100.

The cap 1222 prevents the screw-connection of the screw part 128 to the screw hole 150 of the inner portion 122 at a position at which the cap 1222 is present. The cap 1222 puts a limit on the movable range of the inner portion 122 with respect to the screw part 128. The cap 1222 puts a limit on the movement of the inner portion 122 toward the tip part of the screw part 128. If the inner portion 122 is located excessively apart from the body wall 114 during the process of attaching the adjustment member 1220, the inner portion 122 is less likely to abut against the corotation prevention portions 162 (see FIG. 7). In this case, the inner portion 122 can abut against the corotation prevention portions 162 by lifting the entire adjustment member 1220, which, however, can worsen workability in attaching the adjustment member 1220. Putting a limit on the movement of the inner portion 122 toward the tip part of the screw part 128 allows the inner portion 122 to easily and smoothly abut against the corotation prevention portions 162. Accordingly, workability in attaching the adjustment member 1220 is improved.

Figure 28:
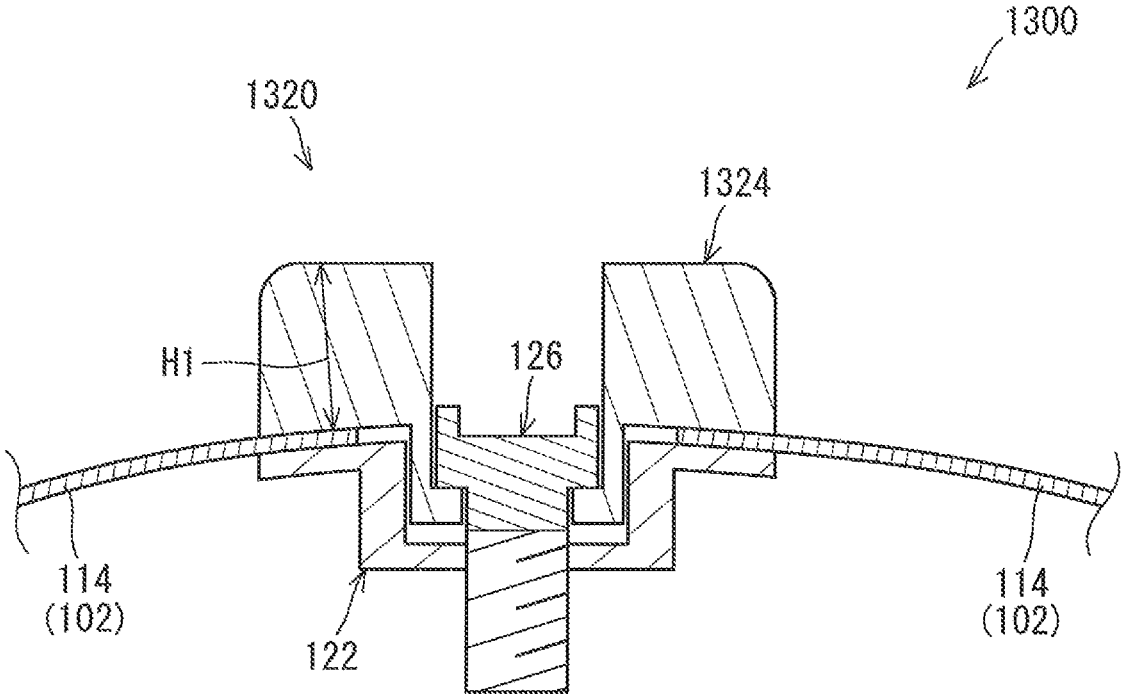
FIG. 28 is a cross-sectional view of an adjustment member and its vicinity of a head according to a thirteenth embodiment.

FIG. 28 is a cross-sectional view of an adjustment member and its vicinity of a head 1300 according to a thirteenth embodiment. FIG. 28 is a cross-sectional view showing the fixed state. The adjustment member 1320 of the head 1300 includes an inner portion 122, an outer portion 1324, and a rotary connecting portion 126. The adjustment member 1320 is fixed to a body wall 114 (head body 102). Except for the shape of the outer portion 1324, the adjustment member 1320 has the same configuration as the adjustment member 120 of the first embodiment, and the head 1300 has the same configuration as the head 100.

The outer portion 1324 has a large height from the head outer surface. The outer portion 1324 is a weight member. The weight of the outer portion 1324 is greater than the weight of the inner portion 122. The specific gravity of the outer portion 1324 is greater than the specific gravity of the inner portion 122. The volume of the outer portion 1324 is greater than the volume of the inner portion 122. When the outer portion 1324 is a weight member, such an outer portion 1324 having a large height can increase the adjustable range of the position of the center of gravity of the head.

A double-pointed arrow H1 in FIG. 28 shows the height of the outer portion 1324. The height H1 is a height measured from the outer surface of the body wall 114 (head body 102). The height H1 can vary depending on the position on the outer surface of the body wall 114. The height H1 is measured along a line normal to the outer surface of the body wall 114. The height H1 is measured when the adjustment member 1320 is in the fixed state. From the viewpoint of increasing the adjustable range of the position of the center of gravity of the head, the maximum value of the height H1 can be set to be greater than or equal to 3 mm, further set to be greater than or equal to 4 mm, and still further set to be greater than or equal to 5 mm. An excessively large height H1 leads to reduced weight of the head body, which worsens the degree of freedom in design of the head body. From this viewpoint, the maximum value of the height H1 can be set to be less than or equal to 10 mm, further set to be less than or equal to 9 mm, and still further set to be less than or equal to 8 mm.

Figure 29:
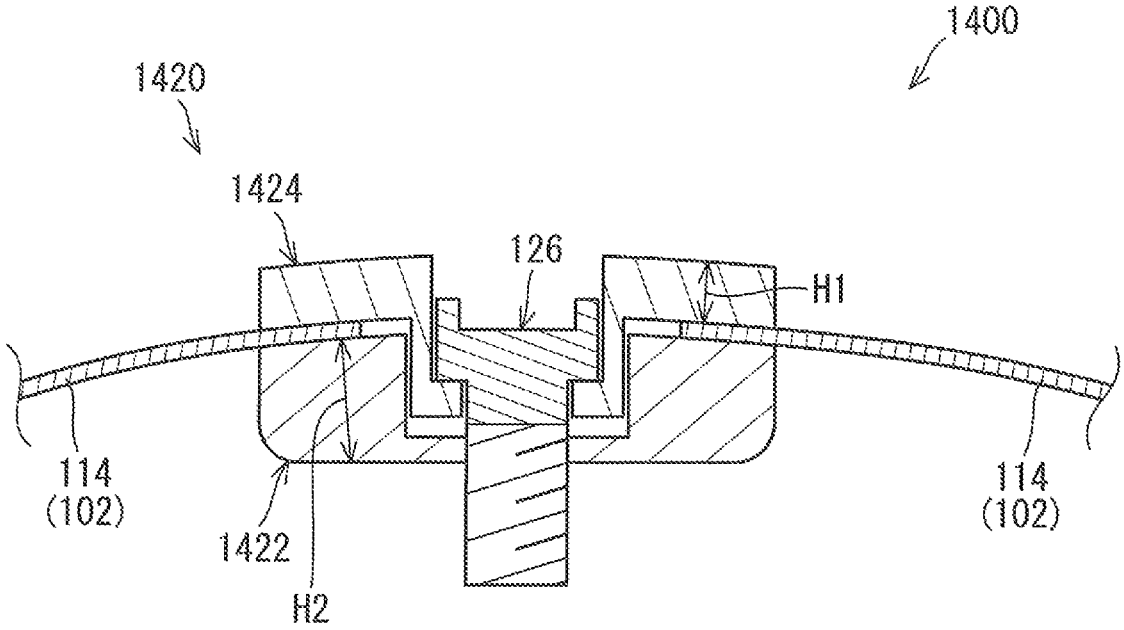
FIG. 29 is a cross-sectional view of an adjustment member and its vicinity of a head according to a fourteenth embodiment.

FIG. 29 is a cross-sectional view of an adjustment member and its vicinity of a head 1400 according to a fourteenth embodiment. FIG. 29 is a cross-sectional view showing the fixed state. The adjustment member 1420 of the head 1400 includes an inner portion 1422, an outer portion 1424, and a rotary connecting portion 126. The adjustment member 1420 is fixed to a body wall 114 (head body 102).

The outer portion 1424 has a small height from the head outer surface. The outer portion 1424 is a weight member. The inner portion 1422 is a weight member. The weight of the inner portion 1422 is greater than the weight of the outer portion 1424. The volume of the inner portion 1422 is greater than the volume of the outer portion 1424. The outer portion 1424 having a small protruding height can have a reduced effect on the position of the center of gravity of the head. Accordingly, for example, when the adjustment member 1420 is disposed in the crown portion, the adjustment member 1420 can prevent the position of the center of gravity of the head from being higher.

From the viewpoint of reducing the effect on the position of the center of gravity of the head, the maximum value of the height H1 can be set to be less than or equal to 6 mm, further set to be less than or equal to 5 mm, and still further set to be less than or equal to 4 mm. From the viewpoint of increasing the weight of the outer portion 1424, the maximum value of the height H1 can be set to be greater than or equal to 1 mm, further set to be greater than or equal to 2 mm, and still further set to be greater than or equal to 3 mm.

A double-pointed arrow H2 in FIG. 29 shows a height of the inner portion 1422. The height H2 is a height measured from the inner surface of the body wall 114 (head body 102). The height H2 can vary depending on the position on the inner surface of the body wall 114 (head body 102). The height H2 is measured along a line normal to the inner surface of the body wall 114. The height H2 is measured when the adjustment member 1420 is in the fixed state. From the viewpoint of increasing the weight of the inner portion 1422, the maximum value of the height H2 can be set to be greater than or equal to 3 mm, further set to be greater than or equal to 4 mm, and still further set to be greater than or equal to 5 mm. An inner portion 1422 having an excessively heavy weight leads to reduced weight of the head body, which worsens the degree of freedom in design of the head body. From this viewpoint, the maximum value of the height H2 can be set to be less than or equal to 15 mm, further set to be less than or equal to 12 mm, and still further set to be less than or equal to 10 mm.

Figure 30:
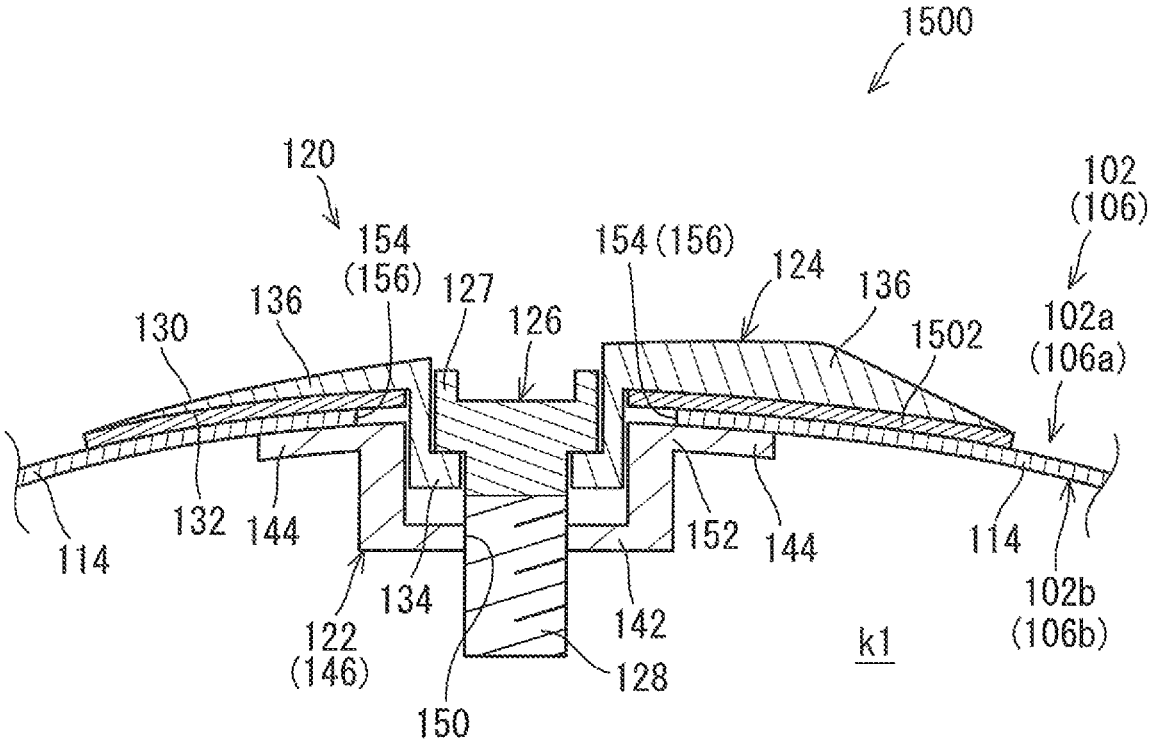
FIG. 30 is a cross-sectional view of an adjustment member and its vicinity of a head according to a fifteenth embodiment.

FIG. 30 is a cross-sectional view of an adjustment member and its vicinity of a head 1500 according to a fifteenth embodiment. In the head 1500, an elastic portion 1502 is provided between a head outer surface 102*a* and an outer portion 124. Except for the presence of the elastic portion 1502, the head 1500 has the same configuration as the head 100 of the first embodiment. The elastic portion 1502 is fixed to the bottom surface 132 of the outer portion 124.

The elastic portion 1502 fills a gap between the head outer surface 102*a* and the outer portion 124. The elastic portion 1502 contributes to stable fixation of the adjustment member 120. When the rotational position of the outer portion 124 is selectable as in the above-described fourth to sixth embodiments, a gap tends to be generated between the head outer surface 102*a* and the outer portion 124. The elastic portion 1502 can absorb the difference in shape between the head outer surface 102*a* and the bottom surface 132 of the outer portion 124, and can fill the gap between them.

From the viewpoint of effectively absorbing the difference in shape between the head outer surface 102*a* and the outer portion 124, an elastic member constituting the elastic portion 1502 has a Young's modulus of preferably less than or equal to 0.3 GPa, more preferably less than or equal to 0.2 GPa, and still more preferably less than or equal to 0.1 GPa. From the viewpoint of stably fixing the adjustment member 120, the Young's modulus is preferably greater than or equal to 0.01 GPa, more preferably greater than or equal to 0.02 GPa, and still more preferably greater than or equal to 0.03 GPa. Examples of this elastic member include an elastomer such as a rubber, and a sponge. Examples of the sponge include a synthetic sponge formed by foaming a resin, and a rubber sponge.

Figure 31A:
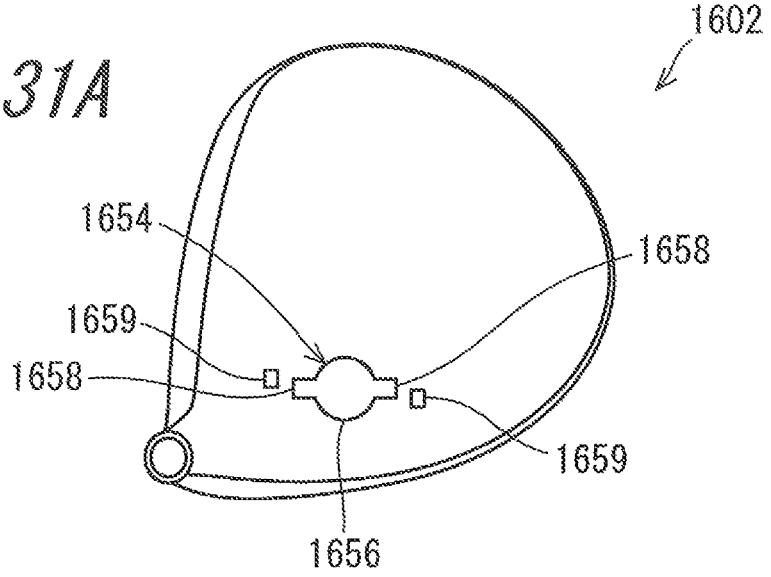
FIG. 31A is a perspective view of a head body according to a sixteenth embodiment.
Figure 31B:
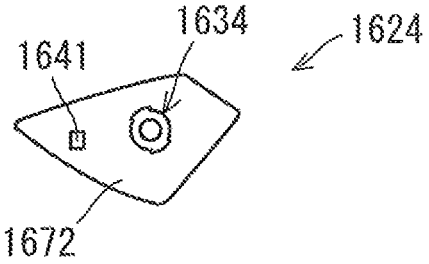
FIG. 31B is a bottom view of an outer portion of an adjustment member according to the sixteenth embodiment.
Figure 31C:
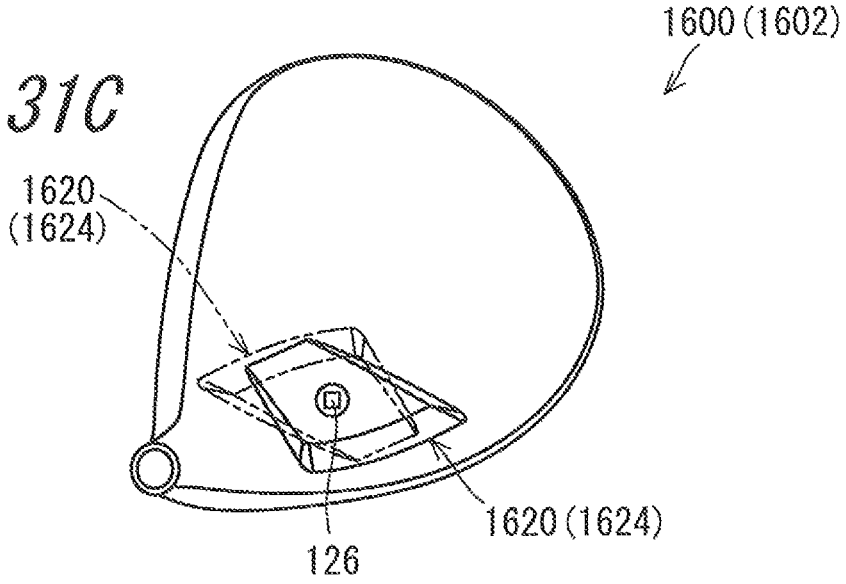
FIG. 31C is a perspective view of a head according to the sixteenth embodiment.

FIG. 31A is a perspective view of a head body 1602 according to a sixteenth embodiment. FIG. 31B is a bottom view of an outer portion 1624 of an adjustment member 1620 according to the sixteenth embodiment. FIG. 31C is a perspective view of a head 1600 of the sixteenth embodiment. The head 1600 includes the head body 1602 and the adjustment member 1620. The adjustment member 1620 includes the outer portion 1624, an inner portion (not shown in the drawings), and a rotary connecting portion 126. The adjustment member 1620 has the same configuration as the adjustment member 720 of the seventh embodiment. The inner portion is not shown in FIG. 31A to FIG. 31C, but has the same configuration as the inner portion 322 of the third embodiment (FIG. 16A to FIG. 16D).

The outer portion 1624 has the same configuration as the outer portion 724 of the seventh embodiment. The outer portion 1624 includes a boss part 1634 and an outer engaging part 1641. The outer engaging part 1641 is a protrusion that protrudes from a bottom surface 1672 of the outer portion 1624. As with the third embodiment (FIG. 18), a corotation prevention portion is constituted by the combination between the outer portion 1624 and the inner portion in the present embodiment. Note that the outer engaging part 1641 may be a recess.

An opening 1654 is formed in the head body 1602. The opening 1654 includes a circular part 1656 and outward extending parts 1658 that extend outward from the circular part 1656. Further, a body engaging part 1659 is formed in the head body 1602. The body engaging part 1659 is a through hole. A plurality of (two) body engaging parts 1659 are provided. The body engaging parts 1659 are provided at positions spaced apart from the opening 1654. The outer engaging part 1641 is inserted into one of the two body engaging parts 1659. The engagement between one of the body engaging parts 1659 and the outer engaging part 1641 determines the orientation (rotational position) of the outer portion 1624. The engagement between one of the body engaging parts 1659 and the outer engaging part 1641 prevents the outer portion 1624 from corotating with the rotary connection portion 126 when the rotary connecting portion 126 is rotated. Note that the body engaging parts 1659 may be recesses that do not penetrate through the body wall, or may be protrusions. The body engaging parts 1659 each should have a shape that can engage with the outer engaging part 1641. When the outer engaging part 1641 is a recess, the body engaging parts 1659 can be protrusions. The head body 1602 has the same configuration as the head body 702 of the seventh embodiment except for the presence of the second body engaging part 1659.

In the sixteenth embodiment, the rotational position of the outer portion 1624 changes depending on which one of the body engaging parts 1659 is selected. In the sixteenth embodiment, there are a plurality of rotational positions of the outer portion 1624 at which the outer engaging part 1641 can engage with one of the body engaging parts 1659.

The number of rotational positions of the outer portion 1624 when the one outer engaging part 1641 can engage with one of the two body engaging parts 1659 is two. These two rational positions are referred to as a first rotational position and a second rotational position. The difference in angular position in the rotational direction of the outer portion 1624 between the first rotational position and the second rotational position is 180°. The outer portion 1624 situated at the first rotational position is indicated by solid line in FIG. 31C. The outer portion 1624 situated at the second rotational position is indicated by two-dot chain line in FIG. 31C. The rotational position of the outer portion 1624 changes aerodynamic properties of the head 1600, for example. The rotational position of the outer portion 1624 changes the position of the center of gravity of the head 1600, for example. The orientation (rotational position) of the outer portion 1624 can be adjusted in the head 1600.

The above-described embodiments exhibit the following advantageous effects. Reference symbols are omitted in the following descriptions as necessary.

Although each adjustment member is configured to sandwich the body wall from the inside and outside of the head body, the adjustment member can be retrofitted to the head body. In other words, the adjustment member can be attached to/detached from the head from the outside of the head. Accordingly, the adjustment member can be attached to/detached from a finished head, and replaced with another adjustment member in a finished head.

The corotation prevention portion can prevent the inner member disposed inside the head body from corotating with the rotary connecting portion. Accordingly, the adjustment member can be surely fixed from the outside of the head.

The corotation prevention portion can be provided on the body wall of the head body as in the body protrusions 164 (FIG. 2, FIG. 7) of the first embodiment. In this case, it is not necessary to provide a corotation prevention portion in the adjustment member.

As explained above with reference to FIG. 7, when the inner portion 122 is inserted from the outside of the head, the inner portion 122 is in a state where the inner portion 122 can pass through the opening 154. Accordingly, at this moment, the rotational position of the inner portion 122 is situated at the pass-through position at which the inner portion 122 can pass through the opening 154. When the inner portion 122 stays at the pass-through position, the inner portion 122 cannot sandwich the body wall 114. The rotational position of the inner portion 122 is shifted from the pass-through position to the non-pass-through position at which the inner portion 122 cannot pass through the opening 154 by utilizing the corotation with the rotary connecting portion 126. When the inner portion 122 is at the non-pass-through position, the body wall 114 can be sandwiched between the inner portion 122 and the outer portion 124. The corotation prevention portion is positioned such that the inner portion 122 is situated at the non-pass-through position when the inner portion 122 abuts against the corotation prevention portion. For this reason, the inner portion 122 can be surely shifted to the non-pass-through position.

As shown in the penetrating protrusion 241 of the second embodiment, the corotation prevention portion may be disposed on the outer portion (FIG. 10B). The penetrating protrusion 241 penetrates through the supplementary opening 259 (FIG. 9) and protrudes from the head inner surface toward the inside of the head. The engagement between the penetrating protrusion 241 and the supplementary opening 259 determines the orientation (rotational position) of the adjustment member 220. Accordingly, the adjustment member 220 can be accurately attached. In addition, the positional deviation of the adjustment member 220 is prevented and the fixing strength of the adjustment member 220 is enhanced.

The penetrating protrusion disposed on the outer portion and the body protrusions disposed on the head body are positioned such that the inner portion that has corotated with the rotary connecting portion can abut against the penetrating protrusion or the body protrusions. As a result, these protrusions function as the corotation prevention portion.

As in the third embodiment, the corotation prevention portion can be disposed in the adjustment member 220. As already explained with reference to FIG. 18, in the third embodiment, the combination between the inner portion 322 and the outer portion 324 constitutes an engagement part that prevents relative rotation between the inner portion 322 and the outer portion 324 at a specific rotational position. This engagement part is the rotation blocking part that blocks relative rotation between the inner portion 322 and the outer portion 324 at the specific rotational position. In the third embodiment, the rotation blocking part is the corotation prevention portion.

In the fourth embodiment (FIG. 19C), the fifth embodiment (FIG. 20C), and the sixth embodiment (FIG. 21C, FIG. 21D), the adjustment member can be fixed at a plurality of orientations (rotational positions). A plurality of supplementary openings are formed in these embodiments. There are a plurality of rotational positions of the outer portion at which the penetrating protrusion(s) can be inserted to the supplementary opening(s). For this reason, the orientation of the adjustment member can be adjusted. The penetrating protrusion(s) further functions as the corotation prevention portion. Also in the sixteenth embodiment (FIG. 31C), the adjustment member can be fixed at a plurality of orientations (rotational positions). In this embodiment, a plurality of body engaging parts are provided. There are a plurality of rotational positions of the outer portion at which the outer engaging part can engage with one of the body engaging parts. For this reason, the orientation of the adjustment member can be adjusted.

Note that the corotation prevention portion does not necessarily have to be a protrusion. For example, the head inner surface may be shaped so as to abut against the inner portion which has been rotated.

There is no limitation on functions of the adjustment member. The adjustment member can be an aerodynamic member that can adjust aerodynamic properties of the head, for example. When the adjustment member is used as the aerodynamic member, the average specific gravity of the entirety of the adjustment member is preferably smaller than the average specific gravity of the entirety of the head body. Alternatively, the adjustment member can be a weight member. When the adjustment member is used as the weight member, the average specific gravity of the entirety of the adjustment member is preferably greater than the average specific gravity of the entirety of the head body. The adjustment member also can adjust the shape (outer shape) of the head.

There is no limitation on specific gravities of portions constituting the adjustment member. For example, the specific gravity of the inner portion can be greater than the specific gravity of the outer portion, and the specific gravity of the rotary connecting portion can be greater than the specific gravity of the inner portion. This configuration can restrain shifting of the position of the center of gravity of the head toward the outer side of the head. Accordingly, when the adjustment member is disposed in the crown portion, this configuration prevents the position of the center of gravity of the head from being higher. This advantageous effect is particularly preferable when the adjustment member is used as the aerodynamic member. Alternatively, the specific gravity of the rotary connecting portion can be greater than the specific gravity of the inner portion, and the specific gravity of the outer portion can be greater than the specific gravity of the rotary connection portion. In this configuration, the position of the center of gravity of the head is easily shifted to the outer side of the head. This advantageous effect is particularly preferable when the adjustment member is used as the weight member.

In the above-described embodiments, the outer portion and the rotary connecting portion are separate members. Alternatively, the outer portion and the rotary connecting portion may be integrally formed as a single-piece member. In this case, the outer portion and the rotary connecting portion rotate together. For example, when the outer portion has a circular shape, a head having this outer portion can have a same shape and configuration even when the outer portion is situated at any rotational position. For example, in such a case, the outer portion and the rotary connecting portion can be integrally formed as a single-piece member.

The rotary connecting portion connects the body wall and the outer portion directly or indirectly. In the above-described embodiments, the rotary connecting portion indirectly connects the body wall and the outer portion by using the inner portion. Alternatively, the rotary connecting portion may directly connect the body wall and the outer portion.

Regarding the above-described embodiments, the following clauses are disclosed.

[Clause 1]

A golf club head including:

a head body that includes a body wall forming a head inner surface and a head outer surface; and at least one adjustment member that is detachably fixed to the head outer surface in a state where the body wall is sandwiched by the adjustment member, wherein the head body has at least one opening that penetrates through the body wall, the adjustment member includes:

an inner portion that includes an inner surface abutment part that abuts against the head inner surface;

an outer portion that includes an outer surface abutment part that abuts against the head outer surface; and a rotary connecting portion that connects the inner portion and the outer portion, rotational positions of the inner portion include a pass-through position that allows the inner portion to pass through the opening, and a non-pass-through position that prevents the inner portion from passing through the opening, the inner surface abutment part situated at the non-pass-through position abuts against the head inner surface, and the head body or the adjustment member includes a corotation prevention portion that prevents the inner portion situated at the non-pass-through position from corotating with the rotary connecting portion.

[Clause 2]

The golf club head according to clause 1, wherein the corotation prevention portion is at least one corotation prevention protrusion that protrudes from the head inner surface toward inside of the golf club head.

[Clause 3]

The golf club head according to clause 2, wherein the body wall includes at least one body protrusion that protrudes from the head inner surface toward inside of the golf club head, and the body protrusion is the corotation prevention portion.

[Clause 4]

The golf club head according to clause 2, wherein the outer portion includes at least one penetrating protrusion that penetrates through the body wall and protrudes from the head inner surface toward inside of the golf club head, the head body has at least one supplementary opening that allows the penetrating protrusion to penetrate through the supplementary opening, and the penetrating protrusion is the corotation prevention portion.

[Clause 5]

The golf club head according to clause 4, wherein the at least one supplementary opening comprises a plurality of supplementary openings, and there are a plurality of rotational positions of the outer portion at which each of the at least one penetrating protrusion is inserted to one of the supplementary openings.

[Clause 6]

The golf club head according to clause 1, wherein a combination between the outer portion and the inner portion constitutes a rotation blocking part that blocks relative rotation between the outer portion and the inner portion at a specific rotational position, and the rotation blocking part is the corotation prevention portion.

[Clause 7]

The golf club head according to any one of clauses 1 to 6, wherein the outer portion further includes at least one outer engaging part that is a protrusion or a recess and engages with the body wall, the body wall further includes at least one body engaging part that engages with the at least one outer engaging part, and neither the outer engaging part nor the body engaging part constitutes the corotation prevention portion.

[Clause 8]

The golf club head according to clause 7, wherein the body engaging part is a through hole that penetrates through the body wall, and the outer engaging part is the protrusion and penetrates through the body engaging part.

[Clause 9]

The golf club head according to clause 7, wherein the body engaging part is a recess that engages with the protrusion of the outer portion and does not penetrate through the body wall, or a protrusion that engages with the recess of the outer portion.

[Clause 10]

The golf club head according to any one of clauses 7 to 9, wherein the at least one body engaging part comprises a plurality of body engaging parts, and there are a plurality of rotational positions of the outer portion at which each of the at least one outer engaging part engages with one of the body engaging parts.

[Clause 11]

The golf club head according to any one of clauses 1 to 10, wherein the outer portion and the rotary connecting portion are separate members.

[Clause 12]

The golf club head according to clause 11, wherein the golf club head further includes a falling-off prevention portion located between the outer portion and the rotary connecting portion, the falling-off prevention portion preventing the rotary connecting portion from falling out of the outer portion while allowing the rotary connecting portion to freely rotate with respect to the outer portion.

LIST OF REFERENCE SYMBOLS

100, 200, 300, 400, 500, 600, 700, 800, 900, 1000, 1000*a*, 1100, 1200, 1300, 1400, 1500, 1600 Golf club head

102, 202, 302, 402, 502, 602, 702, 802, 1002, 1602 Head body

114, 214, 1014 Body wall

120, 220, 320, 420, 620, 720, 820, 920, 1020, 1030, 1120, 1220, 1320, 1420, 1620 Adjustment member

122, 322, 1022, 1122, 1422 Inner portion

124, 224, 324, 424, 624, 724, 824, 1024, 1032, 1124, 1324, 1424, 1624 Outer portion

136, 236, 336, 436, 636 Outer surface abutment part

126, 626, 1126 Rotary connecting portion

152, 352 Inner surface abutment part

154, 254, 354, 454, 554, 654, 754, 854, 1054, 1654 Opening

162 Corotation prevention portion

164 Body protrusion (corotation prevention protrusion)

241, 441, 641 Penetrating protrusion (corotation prevention protrusion)

262 Corotation prevention portion

The above descriptions are merely illustrative and various modifications can be made without departing from the principles of the present disclosure.

The terminology used in the description of the various described embodiments herein is for the purpose of describing particular embodiments only and is not intended to be limiting. The use of the terms "a", "an", "the", and similar referents in the context of throughout this disclosure (especially in the context of the following claims) are to be construed to cover both the singular and the plural, unless otherwise indicated herein or clearly contradicted by context. As used throughout this disclosure, the word "may" is used in a permissive sense (i.e., meaning "having the potential to"), rather than the mandatory sense (i.e., meaning "must"). Similarly, as used throughout this disclosure, the terms "comprising," "having," "including," and "containing" are to be construed as open-ended terms (i.e., meaning "including, but not limited to,") unless otherwise noted.

What is claimed is:

1. A golf club head comprising:

a head body that includes a body wall forming a head inner surface and a head outer surface; and at least one adjustment member that is detachably fixed to the head outer surface in a state where the body wall is sandwiched by the adjustment member, wherein the head body has at least one opening that penetrates through the body wall, the adjustment member includes:

an inner portion that includes an inner surface abutment part that abuts against the head inner surface;

an outer portion that includes an outer surface abutment part that abuts against the head outer surface; and a rotary connecting portion that connects the inner portion and the outer portion, rotational positions of the inner portion include a pass-through position that allows the inner portion to pass through the opening, and a non-pass-through position that prevents the inner portion from passing through the opening, the inner surface abutment part situated at the non-pass-through position abuts against the head inner surface, the head body or the adjustment member includes a corotation prevention portion that prevents the inner portion situated at the non-pass-through position from corotating with the rotary connecting portion, the outer portion further includes at least one outer engaging part that is a protrusion or a recess and engages with the body wall, the body wall further includes at least one body engaging part that engages with the at least one outer engaging part, and neither the outer engaging part nor the body engaging part constitutes the corotation prevention portion.

2. The golf club head according to claim 1, wherein the corotation prevention portion is at least one corotation prevention protrusion that protrudes from the head inner surface toward inside of the golf club head.

3. The golf club head according to claim 2, wherein the body wall includes at least one body protrusion that protrudes from the head inner surface toward inside of the golf club head, and the body protrusion is the corotation prevention portion.

4. The golf club head according to claim 2, wherein the outer portion includes at least one penetrating protrusion that penetrates through the body wall and protrudes from the head inner surface toward inside of the golf club head, the head body has at least one supplementary opening that allows the penetrating protrusion to penetrate through the supplementary opening, and the penetrating protrusion is the corotation prevention portion.

5. The golf club head according to claim 4, wherein the at least one supplementary opening comprises a plurality of supplementary openings, and there are a plurality of rotational positions of the outer portion at which each of the at least one penetrating protrusion is inserted to one of the supplementary openings.

6. The golf club head according to claim 1, wherein a combination between the outer portion and the inner portion constitutes a rotation blocking part that blocks relative rotation between the outer portion and the inner portion at a specific rotational position, and the rotation blocking part is the corotation prevention portion.

7. The golf club head according to claim 1, wherein the body engaging part is a through hole that penetrates through the body wall, and the outer engaging part is the protrusion and penetrates through the body engaging part.

8. The golf club head according to claim 1, wherein the body engaging part is a recess that engages with the protrusion of the outer portion and does not penetrate through the body wall, or a protrusion that engages with the recess of the outer portion.

9. The golf club head according to claim 1, wherein the at least one body engaging part comprises a plurality of body engaging parts, and there are a plurality of rotational positions of the outer portion at which each of the at least one outer engaging part engages with one of the body engaging parts.

10. The golf club head according to claim 1, wherein the outer portion and the rotary connecting portion are separate members.

11. The golf club head according to claim 10, wherein the golf club head further includes a falling-off prevention portion located between the outer portion and the rotary connecting portion, the falling-off prevention portion preventing the rotary connecting portion from falling out of the outer portion while allowing the rotary connecting portion to freely rotate with respect to the outer portion.

12. The golf club head according to claim 1, wherein the outer portion is fixable at a plurality of rotational positions, and the respective rotational positions bring about different aerodynamic properties of the golf club head.

13. A golf club head comprising:

a head body that includes a body wall forming a head inner surface and a head outer surface; and at least one adjustment member that is detachably fixed to the head outer surface in a state where the body wall is sandwiched by the adjustment member, wherein the head body has at least one opening that penetrates through the body wall, the adjustment member includes:

an inner portion that includes an inner surface abutment part that abuts against the head inner surface;

an outer portion that includes an outer surface abutment part that abuts against the head outer surface; and a rotary connecting portion that connects the inner portion and the outer portion, rotational positions of the inner portion include a pass-through position that allows the inner portion to pass through the opening, and a non-pass-through position that prevents the inner portion from passing through the opening, the inner surface abutment part situated at the non-pass-through position abuts against the head inner surface, the head body or the adjustment member includes a corotation prevention portion that prevents the inner portion situated at the non-pass-through position from corotating with the rotary connecting portion, and an average specific gravity of an entirety of the adjustment member is smaller than an average specific gravity of an entirety of the head body.

14. A golf club head comprising:

a head body that includes a body wall forming a head inner surface and a head outer surface; and at least one adjustment member that is detachably fixed to the head outer surface in a state where the body wall is sandwiched by the adjustment member, wherein the head body has at least one opening that penetrates through the body wall, the adjustment member includes:

an inner portion that includes an inner surface abutment part that abuts against the head inner surface;

an outer portion that includes an outer surface abutment part that abuts against the head outer surface; and a rotary connecting portion that connects the inner portion and the outer portion, rotational positions of the inner portion include a pass-through position that allows the inner portion to pass through the opening, and a non-pass-through position that prevents the inner portion from passing through the opening, the inner surface abutment part situated at the non-pass-through position abuts against the head inner surface, the head body or the adjustment member includes a corotation prevention portion that prevents the inner portion situated at the non-pass-through position from corotating with the rotary connecting portion, the outer portion includes a boss part that protrudes from a bottom surface of the outer portion and holds the rotary connecting portion while allowing the rotary connecting portion to freely rotate with respect to the boss part, the rotary connecting portion includes a screw part, the inner portion includes a base part having a screw hole that is screw-connected with the screw part, the boss part is inserted into the base part, and the inner portion is rotatable about the boss part.

* * * * *